US010670980B2

(12) United States Patent
Ohnuma et al.

(10) Patent No.: US 10,670,980 B2
(45) Date of Patent: Jun. 2, 2020

(54) TONER, DEVELOPER, AND IMAGE FORMING APPARATUS

(71) Applicants: Koh Ohnuma, Shizuoka (JP); Tsuyoshi Sugimoto, Kanagawa (JP); Shinya Nakayama, Shizuoka (JP); Hideyuki Santo, Kanagawa (JP); Shin Hasegawa, Tokyo (JP); Suzuka Karato, Shizuoka (JP); Kohsuke Nagata, Shizuoka (JP)

(72) Inventors: Koh Ohnuma, Shizuoka (JP); Tsuyoshi Sugimoto, Kanagawa (JP); Shinya Nakayama, Shizuoka (JP); Hideyuki Santo, Kanagawa (JP); Shin Hasegawa, Tokyo (JP); Suzuka Karato, Shizuoka (JP); Kohsuke Nagata, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/031,490

(22) Filed: Jul. 10, 2018

(65) Prior Publication Data

US 2018/0321606 A1 Nov. 8, 2018

Related U.S. Application Data

(63) Continuation of application No. PCT/JP2017/001591, filed on Jan. 18, 2017.

(30) Foreign Application Priority Data

Jan. 18, 2016 (JP) ..... 2016-007050

(51) Int. Cl.
*G03G 9/08* (2006.01)
*G03G 9/087* (2006.01)
(Continued)

(52) U.S. Cl.
CPC ..... *G03G 9/08755* (2013.01); *G03G 9/08* (2013.01); *G03G 9/087* (2013.01);
(Continued)

(58) Field of Classification Search
CPC ..... G03G 9/08755; G03G 9/08797; G03G 9/08788; G03G 9/08791
(Continued)

(56) References Cited

U.S. PATENT DOCUMENTS 6,773,857 B2 * 8/2004 Nakamura ..... G03G 5/14 399/159
9,134,638 B2 9/2015 Sakashita et al.
(Continued)

FOREIGN PATENT DOCUMENTS

EP 2 833 209 A1 2/2015
EP 3236318 A1 10/2017
(Continued)

OTHER PUBLICATIONS

Japanese Patent Office J-PlatPat machine-assisted English-language translation of JP 2007-093809 A ( pub. Apr. 2007) (Year: 2007).*
(Continued)

*Primary Examiner* — Mark A Chapman
(74) *Attorney, Agent, or Firm* — Oblon, McClelland, Maier & Neustadt, L.L.P.

(57) ABSTRACT

Provided is a toner including a crystalline polyester resin including a constitutional unit derived from saturated aliphatic dicarboxylic acid and a constitutional unit derived from saturated aliphatic diol, an amorphous hybrid resin, an amorphous polyester resin, a release agent, and a colorant, wherein the crystalline polyester resin includes a constitutional unit derived from sebacic acid as the constitutional unit derived from the saturated aliphatic dicarboxylic acid, and the amorphous hybrid resin is a composite resin includ-
(Continued)

ing a polyester-based resin unit and a styrene-based resin unit.

8 Claims, 4 Drawing Sheets

(51) Int. Cl.
*G03G 15/08* (2006.01)
*G03G 15/20* (2006.01)

(52) U.S. Cl.
CPC ..... *G03G 9/08786* (2013.01); *G03G 9/08788* (2013.01); *G03G 9/08791* (2013.01); *G03G 9/08795* (2013.01); *G03G 9/08797* (2013.01); *G03G 15/0865* (2013.01); *G03G 15/2064* (2013.01)

(58) Field of Classification Search
USPC ..... 430/109.4
See application file for complete search history.

(56) References Cited

U.S. PATENT DOCUMENTS

| | | | | |
|---|---|---|---|---|
| 9,141,013 | B2 | 9/2015 | Moriya et al. | |
| 9,400,439 | B2 | 7/2016 | Nagata et al. | |
| 2008/0102393 | A1 | 5/2008 | Hasegawa | |
| 2011/0281213 | A1 | 11/2011 | Sakashita et al. | |
| 2012/0052434 | A1 | 3/2012 | Sugimoto et al. | |
| 2012/0064447 | A1 | 3/2012 | Hozumi et al. | |
| 2012/0082926 | A1 | 4/2012 | Suzuki et al. | |
| 2012/0282000 | A1 | 11/2012 | Nakayama et al. | |
| 2012/0295193 | A1 | 11/2012 | Hanatani et al. | |
| 2013/0045442 | A1 | 2/2013 | Moriya et al. | |
| 2013/0065172 | A1 | 3/2013 | Moriya et al. | |
| 2013/0078563 | A1 | 3/2013 | Nakayama et al. | |
| 2013/0095422 | A1 | 4/2013 | Yamamoto et al. | |
| 2013/0108950 | A1 | 5/2013 | Yamamoto et al. | |
| 2013/0115550 | A1 | 5/2013 | Amemori et al. | |
| 2013/0143155 | A1 | 6/2013 | Santo et al. | |
| 2013/0149642 | A1 | 6/2013 | Sabu et al. | |
| 2013/0157183 | A1 | 6/2013 | Santo et al. | |
| 2013/0157185 | A1 | 6/2013 | Sakashita et al. | |
| 2013/0157193 | A1 | 6/2013 | Moritani et al. | |
| 2013/0171550 | A1 | 7/2013 | Amemori et al. | |
| 2013/0202996 | A1 | 8/2013 | Yamauchi et al. | |
| 2013/0236826 | A1 | 9/2013 | Makabe et al. | |
| 2013/0244011 | A1 | 9/2013 | Sabu et al. | |
| 2013/0244153 | A1 | 9/2013 | Nakayama et al. | |
| 2013/0244154 | A1 | 9/2013 | Yamamoto et al. | |
| 2013/0244167 | A1 | 9/2013 | Yamashita et al. | |
| 2013/0244168 | A1 | 9/2013 | Yamashita et al. | |
| 2013/0252158 | A1 | 9/2013 | Yamada et al. | |
| 2013/0260298 | A1 | 10/2013 | Amemori et al. | |
| 2013/0330666 | A1* | 12/2013 | Fukuri | G03G 9/08755 430/109.4 |
| 2013/0337374 | A1 | 12/2013 | Sugimoto et al. | |
| 2014/0023965 | A1 | 1/2014 | Chiba et al. | |
| 2014/0051019 | A1 | 2/2014 | Sekiguchi et al. | |
| 2014/0065534 | A1 | 3/2014 | Amemori et al. | |
| 2014/0080046 | A1 | 3/2014 | Asahina et al. | |
| 2014/0080050 | A1 | 3/2014 | Asahina et al. | |
| 2014/0270874 | A1 | 9/2014 | Hase et al. | |
| 2014/0272689 | A1 | 9/2014 | Yamashita et al. | |
| 2014/0272695 | A1 | 9/2014 | Moritani et al. | |
| 2014/0272696 | A1 | 9/2014 | Yamashita et al. | |
| 2014/0272698 | A1 | 9/2014 | Yamada et al. | |
| 2014/0342283 | A1 | 11/2014 | Yamamoto et al. | |
| 2014/0363184 | A1 | 12/2014 | Santo et al. | |
| 2015/0037722 | A1 | 2/2015 | Yamazaki et al. | |
| 2015/0153671 | A1 | 6/2015 | Yamauchi et al. | |
| 2015/0227066 | A1 | 8/2015 | Sugiura et al. | |
| 2015/0227071 | A1 | 8/2015 | Sakashita et al. | |
| 2015/0248070 | A1 | 9/2015 | Chiba et al. | |
| 2015/0248073 | A1 | 9/2015 | Nakayama et al. | |
| 2015/0253687 | A1 | 9/2015 | Chiba et al. | |
| 2015/0261113 | A1 | 9/2015 | Takeyama et al. | |
| 2015/0323878 | A1 | 11/2015 | Takeyama et al. | |
| 2016/0004179 | A1 | 1/2016 | Sugimoto et al. | |
| 2016/0091813 | A1* | 3/2016 | Yoshiba | G03G 9/08797 430/109.4 |
| 2016/0209766 | A1 | 7/2016 | Chiba et al. | |
| 2016/0209767 | A1 | 7/2016 | Nagata et al. | |
| 2016/0223926 | A1 | 8/2016 | Miyaake et al. | |
| 2016/0231661 | A1 | 8/2016 | Nagai et al. | |
| 2017/0363980 | A1* | 12/2017 | Nagata | G03G 9/08708 |
| 2017/0363981 | A1 | 12/2017 | Watanabe et al. | |

FOREIGN PATENT DOCUMENTS

| | | | |
|---|---|---|---|
| JP | 2579150 | | 11/1996 |
| JP | 11-133665 | | 5/1999 |
| JP | 2001-158819 | | 6/2001 |
| JP | 2002-287400 | | 10/2002 |
| JP | 2002-351143 | | 12/2002 |
| JP | 2004-046095 | | 2/2004 |
| JP | 2006-030685 | | 2/2006 |
| JP | 2007-093809 | | 4/2007 |
| JP | 2007-271789 | | 10/2007 |
| JP | 4079255 | | 2/2008 |
| JP | 2012-053196 | | 3/2012 |
| JP | 5366238 | | 9/2013 |
| JP | 2014-13384 | A * | 1/2014 |
| JP | 5563971 | | 6/2014 |
| JP | 5658064 | | 12/2014 |
| JP | 2015-045850 | | 3/2015 |
| JP | 2015-072378 | | 4/2015 |
| JP | 2016-045358 | | 4/2016 |
| JP | 2016-053677 | | 4/2016 |
| JP | 5937667 | | 5/2016 |
| JP | 2016-114824 | | 6/2016 |
| JP | 2016-114826 | | 6/2016 |
| JP | 2016-114829 | | 6/2016 |
| JP | 2016-133578 | | 7/2016 |
| JP | 2017-072758 | A | 4/2017 |

OTHER PUBLICATIONS

Windholz, M, et al, ed., The Merck Index, ninth edition, Merck & Co., Inc., NJ (1976), p. 1090, No. 8167. (Year: 1976).*
Espacenet machine-assisted Entlish-language translation of JP 2015-072378 A1 (pub. Apr. 2015). (Year: 2015).*
International Search Report dated Apr. 11, 2017 for counterpart International Patent Application No. PCT/JP2017/001591 filed Jan. 18, 2017 (with English Translation).
Written Opinion dated Apr. 11, 2017 for counterpart International Patent Application No. PCT/JP2017/001591 filed Jan. 18, 2017.
Extended European Search Report dated Nov. 21, 2018 in European Patent Application No. 17741441.4, 7 pages.
Office Action dated Mar. 26, 2019, in Japanese Patent Application No. 2017-562860.

* cited by examiner

TONER, DEVELOPER, AND IMAGE FORMING APPARATUS

CROSS-REFERENCE TO RELATED APPLICATIONS

The present application is a continuation application of International Application No. PCT/JP2017/001591, filed Jan. 18, 2017, which claims priority to Japanese Patent Application No. 2016-007050, filed Jan. 18, 2016. The contents of these applications are incorporated herein by reference in their entirety.

BACKGROUND OF THE INVENTION

Field of the Invention

The present disclosure relates to a toner, a developer, and an image forming apparatus.

Description of the Related Art

In recent years, a toner is desired to have the smaller particle diameters to achieve the higher quality of output images, hot offset resistance, low-temperature fixing ability to achieve energy saving, and heat resistant storage stability for enduring high temperatures and high humidity during storage or transportation after production. Particularly, an improvement in low-temperature fixing ability is very important because electric power consumption during fixing occupies a large proportion of electric power consumption during an image forming step.

In the art, a toner produced by a kneading-pulverizing method has been used. The toner produced by the kneading-pulverizing method has irregular shapes with a broad particle size distribution, and it is difficult to obtain smaller particle diameters. Therefore, the toner produced by the kneading-pulverizing method has problems, such as insufficient quality of output images and high fixing energy. In the case where wax (release agent) is added to a toner for improving fixing ability of the toner, moreover, a large amount of the wax is present on a surface of the toner particles of the toner produced by the kneading-pulverizing method because the kneaded product is cracked at the surface of the wax during pulverization to produce the toner particles. Therefore, a releasing effect is enhanced, but depositions (filming) of the toner to a carrier, a photoconductor, and a blade tend to occur. Accordingly, the toner produced by the kneading-pulverizing method has a problem that characteristics of the toner on the whole are not satisfactory.

In order to solve the above-described problems associated with the kneading-pulverizing method, therefore, proposed is a production method of a toner according to a polymerization method. The toner produced by the polymerization method can easily achieve small particle diameters, a particle size distribution of the toner is sharp compared to a particle size distribution of a toner produced by a pulverization method, and moreover, a release agent can be encapsulated in toner particles of the toner produced by the polymerization method. As a production method of a toner according to the polymerization method, disclosed is a method where a toner is produced from an elongation urethane-modified polyester as a toner binder for the purpose of improving low-temperature fixing ability and hot offset resistance (for example, Japanese Unexamined Patent Application Publication No. 11-133665).

Moreover, disclosed is a production method of a toner that excels in all of heat resistant storage stability, low-temperature fixing ability, and hot offset resistance, as well as having excellent powder flowability and transfer properties in case of the toner of small particle-diameters (for example, Japanese Unexamined Patent Application Publication No. 2002-287400 and Japanese Unexamined Patent Application Publication No. 2002-351143). Moreover, disclosed is a production method of a toner, where the method includes a maturing step for producing a toner binder having a stable molecular-weight distribution and obtaining both low-temperature fixing ability and hot offset resistance (for example, Japanese Patent No. 2579150 and Japanese Unexamined Patent Application Publication No. 2001-158819).

For the purpose of obtaining a high level of low-temperature fixing ability, proposed is a toner including a resin, which includes a crystalline polyester resin, and a release agent, where the resin and the wax are incompatible to each other and the toner has a see-island phase separation structure (for example, Japanese Unexamined Patent Application Publication No. 2004-46095).

Moreover, proposed is a toner including a crystalline polyester resin, a release agent, and a graft polymer (for example, Japanese Unexamined Patent Application Publication No. 2007-271789).

For the purpose of obtaining high levels of low-temperature fixing ability, heat resistant storage stability, and hot offset resistance without causing filming, therefore, proposed is a toner including a graft-modified polymer (for example, Japanese Unexamined Patent Application Publication No. 2012-53196).

SUMMARY OF THE INVENTION

According to one aspect of the present disclosure, a toner (<1>) includes a crystalline polyester resin including a constitutional unit derived from saturated aliphatic dicarboxylic acid and a constitutional unit derived from saturated aliphatic diol, an amorphous hybrid resin, an amorphous polyester resin, a release agent, and a colorant. The crystalline polyester resin includes a constitutional unit derived from sebacic acid as the constitutional unit derived from the saturated aliphatic dicarboxylic acid. The amorphous hybrid resin is a composite resin including a polyester-based resin unit and a styrene-based resin unit.

DESCRIPTION OF THE EMBODIMENTS

Figure 1:
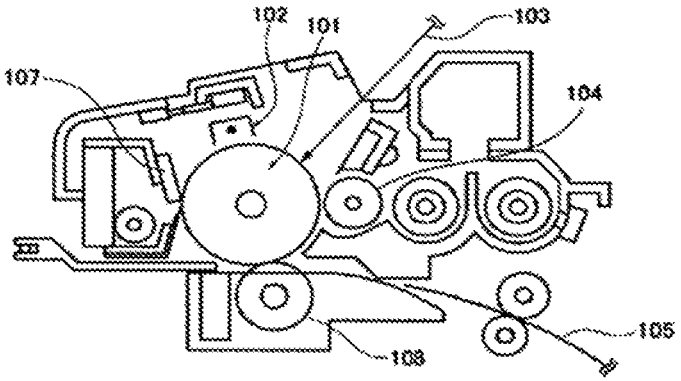
FIG. 1 is a schematic view illustrating one example of a process cartridge according to the present disclosure.

The toner disclosed in Japanese Patent No. 2579150 and Japanese Unexamined Patent Application Publication No. 2001-158819 does not satisfy a high level of low-temperature fixing ability currently required. Moreover, the toner disclosed in Japanese Unexamined Patent Application Publication Nos. 2004-46095, 2007-271789, and 2012-53196 obtains heat resistant storage stability, hot offset resistance, and low-temperature fixing ability, but dispersibility of the polyester resin and the release agent is not sufficient. Therefore, uneven distribution on a surface cannot be prevented and hence filming may occur. Moreover, high levels of heat resistant storage stability and stress resistance currently required cannot be satisfied.

Accordingly, there is currently a need for developing a toner having excellent low-temperature fixing ability, hot offset resistance, stress resistance, and heat resistant storage stability without causing filming, and a developer including the toner.

The present disclosure aims to achieve the following object. Specifically, an object of the present disclosure is to provide a toner having excellent low-temperature fixing ability, hot offset resistance, stress resistance, and heat resistant storage stability without causing filming.

The present disclosure can provide a toner having excellent low-temperature fixing ability, hot offset resistance, stress resistance, and heat resistant storage stability.

Since an aspect of the present disclosure <1> above includes the following <2> to <6>, <2> to <6> will be also described along with <1>.

<2> The toner according to <1>, wherein the crystalline polyester resin includes a constitutional unit derived from straight-chain aliphatic diol having from 2 through 8 carbon atoms as the constitutional unit derived from the saturated aliphatic diol.

<3> The toner according to <1> or <2>, wherein SP1, SP2, and SP3 satisfy formulae (1) to (3) below, $$SP1<SP3<SP2 \quad \text{Formula (1)}$$

$$0.4<SP2-SP1<1.1 \quad \text{Formula (2)}$$

$$0.1<SP3-SP1<1.0 \quad \text{Formula (3)}$$

where SP1 is an SP value of the crystalline polyester resin, SP2 is an SP value of the amorphous polyester resin, and SP3 is an SP value of the amorphous hybrid resin.

<4> The toner according to any one of <1> to <3>, wherein a glass transition temperature (Tg1st) determined from a DSC curve of first heating as measured by differential scanning calorimetry (DSC) is from 45° C. through 55° C.

<5> A developer including:

the toner according to any one of <1> to <4>.

<6> An image forming apparatus including:

an electrostatic latent image-bearer;

an electrostatic latent image-forming unit configured to form an electrostatic latent image on the electrostatic latent image-bearer; and a developing unit that includes a toner and is configured to develop the electrostatic latent image formed on the electrostatic latent image-bearer to form a visible image, wherein the toner is the toner according to any one of <1> to <4>.

(Toner)

The toner of the present disclosure includes at least an amorphous polyester resin, a crystalline polyester resin, an amorphous hybrid resin, a colorant, and a release agent. The toner may further include other components according to the necessity.

The crystalline polyester resin is a crystalline polyester resin including a constitutional unit derived from saturated aliphatic dicarboxylic acid and a constitutional unit derived from saturated aliphatic diol. The crystalline polyester resin includes a constitutional unit derived from sebacic acid as the constitutional unit derived from saturated aliphatic dicarboxylic acid. The amorphous hybrid resin is a composite resin including a polyester-based resin unit and a styrene-based resin unit.

SP1, SP2, and SP3 of the toner preferably satisfy Formulae (1) to (3) below, $$SP1<SP3<SP2 \quad \text{Formula (1)}$$

$$0.4<SP2-SP1<1.1 \quad \text{Formula (2)}$$

$$0.1<SP3-SP1<1.0 \quad \text{Formula (3)}$$

where SP1 is an SP value of the crystalline polyester resin, SP2 is an SP value of the amorphous polyester resin, and SP3 is an SP value of the amorphous hybrid resin.

Dispersibility of the crystalline polyester resin in the toner can be improved by selecting SP values in a manner that an SP value of the amorphous hybrid resin (SP3) is an SP value to achieve intermediate polarity between an SP value of the crystalline polyester resin (SP1) and an SP value of the amorphous polyester resin (SP2), and a combination of SP2 and SP1 and a combination of SP3 and SP1 each have an appropriate SP value difference, as with the relationships of Formulae (1) to (3). Owing to the relationships as mentioned, it is possible to homogeneously finely disperse the crystalline polyester resin inside the toner, filming of the crystalline polyester resin prevented to a great degree, stress resistance is improved further, and further excellent low-temperature fixing ability of the toner can be achieved.

In case of [SP2≤SP3], a dispersing effect of the amorphous hybrid resin against the crystalline polyester resin reduces, dispersed diameters of the crystalline polyester resin become large, the Polyester Resin A tends to be unevenly distributed on a surface of the toner, and therefore filming of the crystalline polyester resin and contamination with the crystalline polyester resin tend to occur.

In case of [SP3≤SP1], a dispersing effect of the amorphous hybrid resin against the crystalline polyester resin reduces, dispersed diameters of the crystalline polyester resin become large, the crystalline polyester resin tends to be unevenly distributed on a surface of the toner, and therefore filming of the crystalline polyester resin and contamination with the crystalline polyester resin tend to occur.

In a case where [SP2−SP1] is 0.4 or less, the compatibility between the crystalline polyester resin and the amorphous polyester resin becomes high and the crystalline polyester resin contained in the toner is dispersed inside the toner, but crystallinity of the crystalline polyester resin reduces and heat resistant storage stability may be impaired.

In a case where [SP2−SP1] is 1.1 or greater, a difference in the SP value between the crystalline polyester resin and the amorphous polyester resin becomes large, the crystalline polyester resin contained in the toner is unevenly distributed near a surface of the toner due to an interaction of polarity, and hence low-temperature fixing ability, heat resistant storage stability, and stress resistance may be impaired.

In a case where [SP3−SP1] is 0.1 or less, the compatibility between the amorphous hybrid resin and the crystalline polyester resin becomes excessive, and therefore a softening effect of the crystalline polyester resin is not sufficiently exhibited and low-temperature fixing ability may be poor.

In a case where [SP3−SP1] is 1.0 or greater, a dispersing effect of the amorphous hybrid resin against the crystalline polyester resin is not sufficiently exhibited, dispersed diameters of the crystalline polyester resin become large, the Polyester Resin A tends to be unevenly distributed on a surface of the toner, filming and contamination may occur.

An average particle diameter of the crystalline polyester is preferably from 0.1 μm through 2.0 μm. When the average particle diameter of the crystalline polyester resin is too large, exposure of the crystalline polyester resin to a surface of the toner increases and hence filming may be worsened. The average particle diameter can be determined by observing a cross-section of the toner under scanning electron microscope (SEM).

<Amorphous Polyester Resin>

The amorphous polyester resin is obtained using a polyvalent alcohol component and a polyvalent carboxylic acid component, such as polyvalent carboxylic acid, polyvalent carboxylic acid anhydride, and polyvalent carboxylic acid ester.

Note that, in the present disclosure, the amorphous polyester resin means an amorphous polyester resin using a polyvalent alcohol component and a polyvalent carboxylic acid component, such as polyvalent carboxylic acid, polyvalent carboxylic acid anhydride, and polyvalent carboxylic acid ester as described above, and modified polyester resins (e.g., prepolymers described later and resins obtained through a cross-linking and/or elongation reaction of the prepolymers) and the amorphous hybrid resin do not belong to the amorphous polyester resin.

Examples of the polyvalent alcohol component include: alkylene (the number of carbon: from 2 through 3) oxide adducts (the number of moles added: from 1 through 10) of bisphenol A, such as polyoxypropylene(2.2)-2,2-bis(4-hydroxyphenyl)propane and polyoxyethylene(2.2)-2,2-bis(4-hydroxyphenyl)propane; ethylene glycol; propylene glycol; neopentyl glycol; glycerin; pentaerythritol; trimethylolpropane; hydrogenated bisphenol A; sorbitol; or alkylene (the number of carbon atoms: from 2 through 3) oxide adducts (the number of moles added: from 1 through 10) of the above-listed polyvalent alcohol components. The above-listed examples may be used alone or in combination.

Examples of the polyvalent carboxylic acid include: dicarboxylic acids, such as adipic acid, phthalic acid, isophthalic acid, terephthalic acid, fumaric acid, and maleic acid; succinic acid substituted with an alkyl group having from 1 through 20 carbon atoms or an alkenyl group having from 2 through 20 carbon atoms, such as dodecenyl succinic acid and octyl succinic acid; trimellitic acid; pyromellitic acid; anhydrides of the above-listed acids; and alkyl (the number of carbon atoms: from 1 through 8) esters of the above-listed acids. The above-listed examples may be used alone or in combination.

The amorphous polyester resin and a prepolymer described later and/or a resin obtained through a cross-linking and/or elongation reaction of the prepolymer are preferably partially compatible to each other. Since the above-mentioned resins are compatible to each other, low-temperature fixing ability and hot offset resistance can be improved. Therefore, the polyvalent alcohol component and polyvalent carboxylic acid component constituting the amorphous polyester resin and the polyvalent alcohol component and polyvalent carboxylic acid component constituting the below-described prepolymer preferably have similar compositions.

A molecular weight of the amorphous polyester resin is not particularly limited and may be appropriately selected depending on the intended purpose. When the molecular weight is too low, heat resistant storage stability of a resultant toner may be poor and durability against stress, such as stirring inside a developing device, may be poor. When the molecular weight is too high, viscoelasticity of a resulting toner becomes high when the toner is melted and therefore low-temperature fixing ability may be poor. Accordingly, in GPC measurements, a weight average molecular weight (Mw) is preferably from 2,500 through 10,000, a number average molecular weight (Mn) is preferably from 1,000 through 4,000, and Mw/Mn is preferably from 1.0 through 4.0.

Moreover, the weight average molecular weight (Mw) is preferably from 3,000 through 6,000, the number average molecular weight (Mn) is preferably from 1,500 through 3,000, and Mw/Mn is preferably from 1.0 through 3.5.

An acid value of the amorphous polyester resin is not particularly limited and may be appropriately selected depending on the intended purpose. The acid value is preferably from 1 mgKOH/g through 50 mgKOH/g and more preferably from 5 mgKOH/g through 30 mgKOH/g. When the acid value is 1 mgKOH/g or greater, a resulting toner tends to be negatively charged, and an affinity between the toner and paper increases during fixing to the paper. Accordingly, low temperature fixing ability of the toner is improved. When the acid value is 50 mgKOH/g or less, reduction in charge stability, especially charge stability over environmental changes, may be suppressed.

A hydroxyl value of the amorphous polyester resin is not particularly limited and may be appropriately selected depending on the intended purpose. The hydroxyl value is preferably 5 mgKOH/g or greater.

A glass transition temperature (Tg) of the amorphous polyester resin is not particularly limited and may be appropriately selected depending on the intended purpose. When the Tg is low, heat resistant storage stability of a resultant toner and durability against stress, such as stirring inside a developing device, may be poor. When the Tg is too high, viscoelasticity of a resultant toner becomes high when the toner is melted and therefore low-temperature fixing ability may be poor. Accordingly, the glass transition temperature (Tg) is preferably from 40° C. through 70° C. and more preferably from 45° C. through 60° C.

An amount of the amorphous polyester resin is not particularly limited and may be appropriately selected depending on the intended purpose. The amount of the amorphous polyester resin is preferably from 50 parts by mass through 95 parts by mass and more preferably 60 parts by mass through 90 parts by mass relative to 100 parts by mass of the toner. When the amount is less than 50 parts by mass, dispersibility of a pigment and a release agent inside a toner is poor, fogging of an image or distortion of the image tends to occur. When the amount is greater than 95 parts by mass, the amount of the crystalline polyester becomes too small, which may cause poor low-temperature fixing ability. The amount of the amorphous polyester resin being the above-mentioned more preferable range is advantageous because all of high quality, high stability, and low-temperature fixing ability excel.

A molecular structure of the amorphous polyester resin can be confirmed by, in addition to solution or solid NMR spectroscopy, X-ray diffraction spectroscopy, GC/MS, LC/MS, or IR spectroscopy. Examples of the simple confirmation method include a method where, in an IR absorption spectrum, the one that does not have absorption peaks derived from δCH (out plane bending) of olefin at 965±10 $cm^{-1}$ and 990±10 $cm^{-1}$ is detected as the amorphous polyester resin.

<Crystalline Polyester Resin>

The crystalline polyester resin includes a constitutional unit derived from saturated aliphatic dicarboxylic acid and a constitutional unit derived from saturated aliphatic diol. The crystalline polyester resin includes a constitutional unit derived from sebacic acid as the constitutional unit derived from saturated aliphatic dicarboxylic acid.

As the saturated aliphatic diol, an alcohol component including straight-chain aliphatic diol having from 2 through 12 carbon atoms is preferably used. The saturated aliphatic diol more preferably includes straight-chain aliphatic diol having from 2 through 8 carbon atoms.

When a crystalline polyester resin including an alcohol component including straight-chain aliphatic diol having from 2 through 8 carbon atoms and sebacic acid is selected as the crystalline polyester resin, dispersibility of the crystalline polyester resin in a toner can be further improved. As a result, the crystalline polyester resin can be homogeneously and finely dispersed inside the toner, and therefore filming of the Polyester Resin A can be prevented, stress resistance can be improved, and low-temperature fixing ability of the toner can be achieved.

In the case where a crystalline polyester resin that includes an alcohol component including a straight-chain aliphatic diol having from 2 through 8 carbon atoms and sebacic acid is selected as the crystalline polyester resin, moreover, a dispersing effect of the amorphous hybrid resin against the crystalline polyester resin improves and therefore dispersed diameters of the crystalline polyester resin do not become large, the crystalline polyester resin is not unevenly distributed on a surface of a toner, and filming of or pollution with crystalline polyester resin is hardly caused.

Since the crystalline polyester resin has high crystallinity, the crystalline polyester resin has thermofusion properties where viscosity rapidly decreases at around a fixing onset temperature. When the crystalline polyester resin having the above-mentioned characteristics is used in the toner, excellent heat resistance storage stability is obtained just before a melt onset temperature owing to crystallinity and a significant reduction in viscosity (sharp melting) occurs at the melt onset temperature to perform fixing. Therefore, a toner having excellent storage stability and low-temperature fixing ability can be obtained. Moreover, an excellent result of a release width (a difference between a minimum fixing temperature and a hot-offset onset temperature) is obtained.

The crystalline polyester resin is obtained using a polyvalent alcohol component and a polyvalent carboxylic acid component, such as polyvalent carboxylic acid, polyvalent carboxylic acid anhydride, and polyvalent carboxylic acid ester.

Note that, in the present disclosure, the crystalline polyester resin means, as described above, a crystalline polyester resin obtained using a polyvalent alcohol component and a polyvalent carboxylic acid component, such as polyvalent carboxylic acid, polyvalent carboxylic acid anhydride, and polyvalent carboxylic acid ester. A modified crystalline polyester resin, such as a prepolymer described later and a resin obtained through across-linking and/or elongation reaction of the prepolymer does not belong to the crystalline polyester resin.

—Polyvalent Alcohol Component—

The polyvalent alcohol component is not particularly limited and may be appropriately selected depending on the intended purpose. Examples of the polyvalent alcohol component include diols and trivalent or higher alcohols.

Examples of the diols include saturated aliphatic diols. Examples of the saturated aliphatic diol include straight-chain-type saturated aliphatic diol and branched-chain-type saturated aliphatic diol. Among the above-listed examples, straight-chain-type saturated aliphatic diol is preferable and straight-chain-type saturated aliphatic diol having from 2 through 12 carbon atoms is more preferable. When the saturated aliphatic diol is a branched chain type, crystallinity of Polyester Resin A reduces, and a melting point may be reduced. When the number of carbon atoms of the principle chain part is less than 2 in case of polycondensation with aromatic dicarboxylic acid, a melting temperature becomes high and it may be difficult to perform fixing at a low temperature. When the number of carbon atoms is greater than 12, on the other hand, it is difficult to actually obtain materials. Therefore, the number of carbon atoms is preferably 8 or less.

Examples of the saturated aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among the above-listed examples, ethylene glycol, 1,3-propanediol, 1,4-butanediol, 1,6-hexanediol, 1,8-octanediol, 1,10-decanediol, and 1,12-dodecanediol are preferable because high crystallinity of the Polyester Resin A and excellent sharp melt properties can be obtained.

Examples of the trivalent or higher alcohols include glycerin, trimethylol ethane, trimethylol propane, and pentaerythritol.

The above-listed examples may be used alone or in combination.

—Polyvalent Carboxylic Acid Component—

As the polyvalent carboxylic acid component, sebacic acid is used. However, other divalent carboxylic acids or trivalent or higher carboxylic acids may be used in combination depending on the intended purpose.

Examples of the divalent carboxylic acids include: saturated aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and aromatic dicarboxylic acids, such as phthalic acid, isophthalic acid, terephthalic acid, napthalene-2,6-dicarboxylic acid, and diprotic acid (e.g., malonic acid and mesaconic acid. Moreover, examples of the divalent carboxylic acids include anhydrides of the above-listed divalent carboxylic acids and lower alkyl esters of the above-listed divalent carboxylic acids.

Examples of the trivalent or higher carboxylic acids include 1,2,4-benzenetricarboxylic acid, 1,2,5-benzenetricarboxylic acid, 1,2,4-naphthalenetricarboxylic acid, anhydrides of the above-listed trivalent or higher carboxylic acids, and lower alkyl esters of the above-listed trivalent or higher carboxylic acids.

As the polyvalent carboxylic acid component, moreover, a dicarboxylic acid component including a sulfonic acid group may be included in addition to the saturated aliphatic dicarboxylic acid or the aromatic dicarboxylic acid. Furthermore, a dicarboxylic acid component including a double bond may be included in addition to the saturated aliphatic dicarboxylic acid or the aromatic dicarboxylic acid.

The above-listed examples may be used alone or in combination.

When any of maleic acid, succinic acid, fumaric acid, terephthalic acid, and derivatives thereof is used as a component of the crystalline polyester resin, a crystalline polyester resin is obtained, but an SP value of the obtained crystalline polyester resin is generally high and therefore the toner cannot easily satisfy the relationships of Formula (1), Formula (2), and Formula (3) above.

The crystalline polyester resin preferably includes a constitutional unit derived from saturated aliphatic dicarboxylic acid and a constitutional unit derived from saturated aliphatic diol because excellent low-temperature fixing ability can be exhibited owing to high crystallinity and excellent sharp melt properties.

A melting point of the crystalline polyester resin is not particularly limited and may be appropriately selected depending on the intended purpose. The melting point is preferably 60° C. or higher but lower than 80° C. When the melting point is lower than 60° C., the crystalline polyester resin tends to melt at a low temperature and hence heat resistant storage stability of the toner may reduce. When the melting point is 80° C. or higher, melting of the crystalline polyester resin upon heating during fixing is insufficient and hence low-temperature fixing ability may reduce.

The melting point can be measured from an endothermic peak value of a DSC chart obtained by measurement using a differential scanning calorimeter (DSC).

A molecular weight of the crystalline polyester resin is not particularly limited and may be appropriately selected depending on the intended purpose. In GPC measurement of an ortho-dichlorobenzene soluble component of Polyester Resin A, a weight average molecular weight (Mw) is preferably from 3,000 through 30,000, a number average molecular weight (Mn) is preferably from 1,000 through 10,000, and Mw/Mn is from 1.0 through 10 because a crystalline polyester resin having a sharp molecular weight distribution and a low molecular weight has excellent low-temperature fixing ability and a crystalline polyester including a large amount of a component having low molecular weight has poor heat resistant storage stability.

Moreover, the weight average molecular weight (Mw) is preferably from 5,000 through 15,000, the number average molecular weight (Mn) is preferably from 2,000 through 10,000, and Mw/Mn is preferably from 1.0 through 5.0.

An acid value of the crystalline polyester resin is not particularly limited and may be appropriately selected depending on the intended purpose. In order to achieve desired low-temperature fixing ability in view of affinity between paper and a resin, the acid value is preferably 5 mgKOH/g or greater and more preferably 10 mgKOH/g or greater. In order to improve hot offset resistance, on the other hand, the acid value is preferably 45 mgKOH/g or less.

A hydroxyl value of the crystalline polyester resin is not particularly limited and may be appropriately selected depending on the intended purpose. In order to achieve desired low-temperature fixing ability and excellent charging properties, the hydroxyl value is preferably from 0 mgKOH/g through 50 mgKOH/g and more preferably from 5 mgKOH/g through 50 mgKOH/g.

A molecular structure of the crystalline polyester resin can be confirmed by X-ray diffraction spectroscopy, GC/MS, LC/MS, or IR spectroscopy, as well as solution or solid NMR spectroscopy. Examples of a simple method for confirming the molecular structure thereof include a method where a compound having absorption based on δCH (out plane bending) of olefin at 965±10 $cm^{-1}$ or 990±10 $cm^{-1}$ in an infrared absorption spectrum thereof is detected as a crystalline polyester resin.

An amount of the crystalline polyester resin is not particularly limited and may be appropriately selected depending on the intended purpose. The amount of the crystalline polyester resin is preferably from 2 parts by mass through 20 parts by mass and more preferably from 5 parts by mass through 15 parts by mass relative to 100 parts by mass of the toner. When the amount is less than 2 parts by mass, low-temperature fixing ability may be poor because sharp melting owing to the crystalline polyester resin is insufficient. When the amount is greater than 20 parts by mass, heat resistant storage stability may be poor and fogging of an image tends to occur. When the amount is within the above-mentioned more preferable range, it is advantageous because all of image quality, stability and low temperature fixing ability are excellent.

<Release Agent>

The release agent is not particularly limited and may be appropriately selected from release agents known in the art.

Examples of wax serving as the release agent include natural wax, such as vegetable wax (e.g. carnauba wax, cotton wax, Japan wax, and rice wax), animal wax (e.g., bees wax and lanolin), mineral wax (e.g., ozokelite and ceresin), and petroleum wax (e.g., paraffin wax, microcrystalline wax and petrolatum).

Examples of the wax other than the natural wax listed above include: synthetic hydrocarbon wax (e.g., Fischer-Tropsch wax, polyethylene wax, and polypropylene wax); and synthetic wax (e.g., ester wax, ketone wax and, ether wax).

Further examples include: fatty acid amide compounds, such as 12-hydroxystearic acid amide, stearic amide, phthalic anhydride imide and chlorinated hydrocarbons; low-molecular-weight crystalline polymer resins such as polyacrylate homopolymers (e.g., poly-n-stearyl methacrylate and poly-n-lauryl methacrylate) and polyacrylate copolymers (e.g., n-stearyl acrylate-ethyl methacrylate copolymers); and crystalline polymers having a long alkyl group as a side chain.

Among the above-listed examples, hydrocarbon-based wax, such as paraffin wax, microcrystalline wax, Fischer-Tropsch wax, polyethylene wax, and polypropylene wax, is preferable.

A melting point of the release agent is not particularly limited and may be appropriately selected depending on the intended purpose. The melting point is preferably 60° C. or higher but lower than 95° C.

The release agent is more preferably hydrocarbon-based wax having a melting point of 60° C. or higher but lower than 95° C. Since such a release agent can effectively function as a release agent at an interface between a fixing roller and a surface of the toner, hot offset resistance can be improved without applying a release agent, such as oil, to the fixing roller.

Particularly, the hydrocarbon-based wax has hardly any compatibility to the crystalline polyester resin and therefore the hydrocarbon-based wax and the crystalline polyester resin can each independently function. Therefore, a softening effect of the crystalline polyester resin as a binder resin and anti-offset properties of the release agent are not impaired hence use of the above-mentioned hydrocarbon-based wax is preferable.

When the melting point of the release agent is lower than 60° C., the release agent tends to melt at a low temperature to thereby impair heat resistant storage stability of a resultant toner. When the melting point of the release agent is 95° C. or higher, the release agent is not sufficiently melted by heat applied during fixing and therefore sufficient anti-offset properties may not be obtained.

An amount of the release agent is not particularly limited and may be appropriately selected depending on the intended purpose. The amount is preferably from 2 parts by mass through 10 parts by mass and more preferably from 3 parts by mass through 8 parts by mass relative to 100 parts by mass of the toner. When the amount is less than 2 parts by mass, hot offset resistance during fixing and low-temperature fixing ability may be poor. When the amount is greater than 10 parts by mass, heat resistant storage stability may be deteriorated and fogging of an image tends to occur. The amount in the above-mentioned more preferable range is advantageous because image quality and fixing stability can be improved.

<Amorphous Hybrid Resin>

As the amorphous hybrid resin, a composite resin including a polyester-based resin component and a styrene-based resin component is used.

The amorphous hybrid resin is a composite resin formed by partially chemically bonding a polyester-based resin component (polyester-based resin unit) and a styrene-based resin component (styrene-based resin unit).

Since the amorphous hybrid resin includes the polyester-based resin unit, dispersibility of the crystalline polyester resin in the toner can be improved. As a result, it is possible to homogeneously and finely disperse the crystalline polyester resin inside the toner, filming of the crystalline polyester resin and the release agent can be prevented, stress resistance can be improved, and low-temperature fixing ability of the toner can be achieved.

The styrene-based resin unit included in the amorphous hybrid resin is preferably a styrene-acryl resin. Since the styrene-acryl resin is included, affinity of the amorphous hybrid resin to the amorphous polyester resin becomes high, a dispersing effect against the crystalline polyester resin improves, and the crystalline polyester resin is easily finely dispersed inside a toner.

The amorphous hybrid resin is preferably a resin obtained by mixing, in addition to a mixture of raw material monomers of two polymer-based resin, i.e., a polyester-based resin unit and a styrene-based resins unit, as one of raw material monomers, a monomer (bireactive monomer) that can react with both of the raw material monomers of the two polymer-based resins.

The bireactive monomer is preferably a monomer including, in a molecule thereof, at least one functional group selected from the group consisting of a hydroxyl group, a carboxyl group, an epoxy group, a primary amino group, and a secondary amino group and an ethylenically unsaturation bond. Use of such a bireactive monomer can improve dispersibility of a resin that is to be a dispersed phase. Specific examples of the bireactive monomer include acrylic acid, fumaric acid, methacrylic acid, citraconic acid, and maleic acid. Among the above-listed examples, acrylic acid, methacrylic acid, and fumaric acid are preferable.

An amount of the bireactive monomer for use is preferably from 0.1 parts by mass through 10 parts by mass relative to 100 parts by mass of raw material monomers of the polyester-based resin. Note that, in the present disclosure, the bireactive monomer is treated as a different monomer from raw material monomers of the polyester-based resin and raw material monomers of addition polymerization-based resin because of specificity of characteristics of the bireactive monomer.

When the amorphous hybrid resin is obtained by performing two polymerization reactions using a mixture of raw material monomers, and the bireactive monomer, in the present disclosure, progress and completion of the polymerization reactions are not necessarily simultaneous. The reactions are each progressed and completed by appropriately selecting a reaction temperature and reaction time according each of to the reaction systems.

In a production method of the amorphous hybrid resin in the present disclosure, for example, formation of a polyester-based resin is preferably performed in the following manners. Raw material monomers of the polyester-based resin, raw material monomers of the addition-based resin, the bireactive monomer, a catalyst, such as a polymerization initiator, etc. are mixed. First, the mixture is mainly allowed to react through a radical polymerization reaction at from 50° C. through 180° C. to obtain an addition polymerization-based resin component having a functional group that enables a condensation polymerization reaction. After elevating the reaction temperature to a range of from 190° C. through 270° C., mainly a polycondensation reaction is performed to form a polyester-based resin.

It is desirable that a softening point of the amorphous hybrid resin is from 80° C. through 170° C., preferably from 90° C. through 160° C., and more preferably from 95° C. through 155° C.

A mass ratio of the crystalline polyester resin to the amorphous hybrid resin is not particularly limited, but the mass ratio of the crystalline polyester resin:the amorphous hybrid resin is preferably from 50/100 through 200/100 (crystalline polyester resin/amorphous hybrid resin).

As raw material monomers of the polyester-based resin constituting the amorphous hybrid resin, raw material monomers identical to the raw material monomers of the crystalline polyester resin can be used. As the carboxylic acid component, a succinic acid-based derivative is preferably used. As raw material monomers of the styrene-based resin constituting the amorphous hybrid resin, styrene derivatives, such as styrene, α-methylstyrene, and vinyl toluene, are used.

An amount of the styrene derivative in raw material monomers of the styrene-based resin is preferably 50% by mass or greater, more preferably 70% by mass or greater, and further more preferably 80% by mass or greater.

Examples of a raw material monomer of a styrene-based resin other than the styrene derivative include: alkyl (meth) acrylate; ethylenically unsaturated monoolefin, such as ethylene and propylene; diolefins, such as butadiene; halovinyls, such as vinyl chloride; vinyl esters, such as vinyl acetate and vinyl propionate; ethylenic monocarboxylic acid esters, such as dimethylaminoethyl (meth)acrylate; vinyl ether, such as vinyl methyl ether; vinylidene halogenated products, such as vinylidene chloride; and N-vinyl compounds, such as N-vinylpyrrolidone.

Among the above-listed examples, alkyl (meth)acrylate is preferable in view of low-temperature fixing ability and charge stability of the toner. In the same view point, the number of carbon atoms of an alkyl group in the alkyl (meth)acrylate is preferably from 1 through 22 and more preferably from 8 through 18. Note that, the number of carbon atoms of the alkyl ester is the number of carbon atoms derived from an alcohol component constituting the ester. Specific examples thereof include methyl (meth)acrylate, ethyl (meth)acrylate, (iso)propyl (meth)acrylate, 2-hydroxyethyl(meth)acrylate, (iso or tertiary)butyl (meth)acrylate, 2-ethylhexyl(meth)acrylate, (iso)octyl (meth)acrylate, (iso)decyl (meth)acrylate, and (iso)stearyl (meth)acrylate.

In view of low-temperature fixing ability, storage stability, and charge stability of a resultant toner, an amount of the alkyl (meth)acrylate is preferably 50% by mass or less, more preferably 30% by mass or less, and even more preferably 20% by mass or less in raw material monomers of the styrene-based resin.

<Colorant>

The colorant is not particularly limited and may be appropriately selected depending on the intended purpose. Examples of the colorant include carbon black, a nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine GB, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS and BC), indigo, ultramarine, iron blue, anthraquinone blue, fast violet B, methylviolet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

An amount of the colorant is not particularly limited and may be appropriately selected depending on the intended purpose. The amount is preferably from 1 part by mass through 15 parts by mass and more preferably from 3 parts by mass through 10 parts by mass relative to 100 parts by mass of the toner.

The colorant may be used in the form of a master batch in which the colorant forms a composite with a resin. Other than the amorphous polyester resin, examples of a resin used for production of the master batch or kneaded together with the master batch include: polymers of styrene or substituted products of styrene, such as polystyrene, poly-p-chlorostyrene, and polyvinyl toluene; styrene-based copolymers, such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate; polybutyl methacrylate; polyvinyl chloride; polyvinyl acetate; polyethylene; polypropylene; polyester; epoxy resins; epoxy polyol resins; polyurethane; polyamide; polyvinyl butyral; polyacrylic acid resins; rosin; modified rosin; terpene resins; aliphatic or alicyclic hydrocarbon resins; aromatic petroleum resins; chlorinated paraffin; and paraffin wax. The above-listed examples may be used alone or in combination.

The master batch can be obtained by mixing or kneading a colorant with the resin for use in the master batch through application of high shearing force. During the mixing or kneading, an organic solvent may be used for enhancing interaction between the colorant and the resin. Moreover, a so-called flashing method is preferably used because a wet cake of the colorant can be directly used without necessity of drying. The flashing method is a method in which an aqueous paste of the colorant including water is mixed and kneaded together with the resin and the organic solvent, the colorant is then transferred to the resin, followed by removing the moisture and the organic solvent component. For the mixing and kneading, a high-shearing disperser, such as a three-roll mill, is preferably used.

<Other Components>

The above-mentioned other components are not particularly limited and may be appropriately selected depending on the intended purpose. Examples thereof include a polymer having a site that can react with an active hydrogen group-containing compound, an active hydrogen group-containing compound, charge-controlling agent, external additives, a flowability-improving agent, a cleaning-improving agent, and a magnetic material.

—Polymer Having Site that can React with Active Hydrogen Group-Containing Compound (Prepolymer)—

The polymer having a site that can react with the active hydrogen group-containing compound (may be referred to as a "prepolymer") is not particularly limited and may be appropriately selected depending on the intended purpose. Examples thereof include polyol resins, polyacryl resins, polyester resins, epoxy resins, and derivatives thereof. The above-listed examples may be used alone or in combination.

Among the above-listed examples, a polyester resin is preferable in view of high flowability during melting and transparency.

Examples of the site that can react with the active hydrogen group-containing compound in the prepolymer include an isocyanate group, an epoxy group, a carboxyl group, and a functional group represented by —COCl. The above-listed examples may be used alone or in combination.

Among the above-listed example, an isocyanate group is preferable.

The prepolymer is not particularly limited and may be appropriately selected depending on the intended purpose. The prepolymer is preferably a polyester resin having an isocyanate group etc. that can generate a urea bond because a molecular weight of a polymer component is easily controlled, and oil-less low-temperature fixing ability with a dry toner, particularly excellent release properties and fixing ability can be secured even when a release oil application system to a heating medium for fixing is not disposed.

—Active Hydrogen Group-Containing Compound—

The active hydrogen group-containing compound functions as an elongation agent, a cross-linking agent, etc., when the polymer having a site that can react with the active hydrogen group-containing compound is allowed to react through an elongation reaction, a cross-linking reaction, etc., in an aqueous medium.

The active hydrogen group is not particularly limited and may be appropriately selected depending on the intended purpose. Examples of the active hydrogen group include a hydroxyl group (an alcoholic hydroxyl group and a phenolic hydroxyl group), an amino group, a carboxyl group, and a mercapto group. The above-listed examples may be used alone or in combination.

The active hydrogen group-containing compound is not particularly limited and may be appropriately selected depending on the intended purpose. When the polymer having a site that can react with the active hydrogen group-containing compound is a polyester resin including an isocyanate group, the active hydrogen group-containing compound is preferably any of amines because a high molecular weight can be obtained through an elongation reaction, a cross-linking reaction, etc. with the polyester resin.

The amines are not particularly limited and may be appropriately selected depending on the intended purpose. Examples of the amines include diamine, trivalent or higher amines, amine alcohols, aminomercaptan, amino acids, and products where an amino group of any of the above-listed amines is blocked. The above-listed examples may be used alone or in combination.

Among the above-listed examples, diamine and a mixture of diamine and a small amount of trivalent or higher amine are preferable.

The diamine is not particularly limited and may be appropriately selected depending on the intended purpose. Examples of the diamine include aromatic diamine, alicyclic diamine, and aliphatic diamine. The aromatic diamine is not particularly limited and may be appropriately selected depending on the intended purpose. Examples of the aromatic diamine include phenylene diamine, diethyltoluene diamine, and 4,4'-diaminodiphenylmethane. The alicyclic diamine is not particularly limited and may be appropriately selected depending on the intended purpose. Examples of the alicyclic diamine include 4,4'-diamino-3,3'-dimethyldicyclohexylmethane, diaminocyclohexane, and isophoronediamine. The aliphatic diamine is not particularly limited and may be appropriately selected depending on the intended purpose. Examples of the aliphatic diamine include ethylene diamine, tetramethylene diamine, and hexamethylene diamine.

The trivalent or higher amine is not particularly limited and may be appropriately selected depending on the intended purpose. Examples of the trivalent or higher amine include diethylenetriamine and triethylenetetramine.

The amino alcohol is not particularly limited and may be appropriately selected depending on the intended purpose. Examples of the amino alcohol include ethanolamine and hydroxyethylaniline.

The aminomercaptan is not particularly limited and may be appropriately selected depending on the intended purpose. Examples of the aminomercaptan include aminoethylmercaptan and aminopropylmercaptan.

The amino acid is not particularly limited and may be appropriately selected depending on the intended purpose. Examples of the amino acid include aminopropionic acid and aminocaproic acid.

The product where an amino group of any of the amines is blocked is not particularly limited and may be appropriately selected depending on the intended purpose. Examples thereof include: ketimine compounds obtained by blocking an amono group with ketones, such as acetone, methyl ethyl ketone, and methyl isobutyl ketone; and oxazoline compounds.

—Polyester Resin Including Isocyanate Group—

The polyester resin including an isocyanate group (may be ref erred to as a "polyester prepolymer having an isocyanate group" here inafter) is not particularly limited and may be appropriately selected depending on the intended purpose. Examples of the polyester resin including an isocyanate group include a reaction product between polyisocyanate and polyester resin having an active hydrogen group obtained through polycondensation of polyol and polycarboxylic acid.

—Polyol—

The polyol is not particularly limited and may be appropriately selected depending on the intended purpose. Examples of the polyol include diol, trivalent or higher alcohols, and mixtures of diol and trivalent or higher alcohol. The above-listed examples may be used alone or in combination.

Among the above-listed examples, diol and a mixture of diol and a small amount of trivalent or higher alcohol are preferable.

The diol is not particularly limited and may be appropriately selected depending on the intended purpose. Examples of the diol include: alkylene glycol, such as ethylene glycol, 1,2-propyleneglycol, 1,3-propyleneglycol, 1,4-butanediol, and 1,6-hexanediol; diol having an oxyalkylene group, such as diethylene glycol, triethylene glycol, dipropylene glycol, polyethylene glycol, polypropylene glycol, and polytetramethylene glycol; alicyclic diol, such as 1,4-cyclohexanedimethanol and hydrogenated bisphenol A; alkylene oxide (e.g., ethylene oxide, propylene oxide, and butylene oxide) adducts of alicyclic diol; bisphenols, such as bisphenol A, bisphenol F, and bisphenol S; and alkylene oxide (e.g., ethylene oxide, propylene oxide, and butylene oxide) adducts of bisphenols. Note that, the number of carbon atoms of the alkyleneglycol is not particularly limited and may be appropriately selected depending on the intended purpose, but the number of the carbon atoms is preferably from 2 through 12.

Among the above-listed examples, alkylene glycol having from 2 through 12 carbon atoms and alkylene oxide adducts of bisphenols are preferable, and alkylene oxide adducts of bisphenols and a mixture of an alkylene oxide adduct of alkylene oxide and alkylene glycol having from 2 through 12 carbon atoms are more preferable.

The trivalent or higher alcohol is not particularly limited and may be appropriately selected depending on the intended purpose. Examples of the trivalent or higher alcohol include trivalent or higher aliphatic alcohol, trivalent or higher polyphenols, and alkylene oxide adducts of trivalent or higher polyphenols.

The trivalent or higher aliphatic alcohol is not particularly limited and may be appropriately selected depending on the intended purpose. Examples of the trivalent or higher aliphatic alcohol include glycerin, trimethylol ethane, trimethylol propane, pentaerythritol, and sorbitol.

The trivalent or higher polyphenols is not particularly limited and may be appropriately selected depending on the intended purpose. Examples of the trivalent or higher polyphenols include trisphenol PA, phenol novolak, and cresol novolak.

Examples of the alkylene oxide adducts of trivalent or higher polyphenols include compounds where alkylene oxides (e.g., ethylene oxide, propylene oxide, and butyrene oxide) are added to trivalent or higher polyphenols.

In the case where the diol and the trivalent or higher alcohol are mixed for use, a mass ratio of the trivalent or higher alcohol to the diol is not particularly limited and may be appropriately selected depending on the intended purpose. The mass ratio is preferably from 0.01% by mass through 10% by mass and more preferably from 0.01% by mass through 1% by mass.

—Polycarboxylic Acid—

The polycarboxylic acid is not particularly limited and may be appropriately selected depending on the intended purpose. Examples of the polycarboxylic acid include dicarboxylic acid, trivalent or higher carboxylic acid, and mixtures of dicarboxylic acid and trivalent or higher carboxylic acid. The above-listed examples may be used alone or in combination.

Among the above-listed example, dicarboxylic acid and a mixture of dicarboxylic acid with a small amount of trivalent or higher polycarboxylic acid are preferable.

The dicarboxylic acid is not particularly limited and may be appropriately selected depending on the intended purpose. Examples of the dicarboxylic acid include divalent alkanoic acid, divalent alkene acid, and aromatic dicarboxylic acid.

The divalent alkanoic acid is not particularly limited and may be appropriately selected depending on the intended purpose. Examples of the divalent alkanoic acid include succinic acid, adipic acid, and sebacic acid.

The divalent alkene acid is not particularly limited and may be appropriately selected depending on the intended purpose. The divalent alkene acid is preferably divalent alkene acid having from 4 through 20 carbon atoms. The divalent alkene acid having from 4 through 20 carbon atoms is not particularly limited and may be appropriately selected depending on the intended purpose. Examples of the divalent alkene acid having from 4 through 20 carbon atoms include maleic acid and fumaric acid.

The aromatic dicarboxylic acid is not particularly limited and may be appropriately selected depending on the intended purpose. The aromatic dicarboxylic acid is preferably aromatic dicarboxylic acid having from 8 through 20 carbon atoms. The aromatic dicarboxylic acid having from 8 through 20 carbon atoms is not particularly limited and may be appropriately selected depending on the intended purpose. Examples of the aromatic dicarboxylic acid having from 8 through 20 carbon atoms include phthalic acid, isophthalic acid, terephthalic acid, and naphthalene dicarboxylic acid.

The trivalent or higher carboxylic acid is not particularly limited and may be appropriately selected depending on the intended purpose. Examples of trivalent or higher carboxylic acid include trivalent or higher aromatic carboxylic acid.

The trivalent or higher aromatic carboxylic acid is not particularly limited and may be appropriately selected depending on the intended purpose. The trivalent or higher aromatic carboxylic acid is preferably trivalent or higher aromatic carboxylic acid having from 9 through 20 carbon atoms. The trivalent or higher aromatic carboxylic acid having from 9 through 20 carbon atoms is not particularly limited and may be appropriately selected depending on the intended purpose. Examples of the trivalent or higher aromatic carboxylic acid having from 9 through 20 carbon atoms include trimellitic acid and pyromellitic acid.

As the polycarboxylic acid, acid anhydride or lower alkyl ester of dicarboxylic acid, or trivalent or higher carboxylic acid, or a mixture of dicarboxylic acid and trivalent or higher carboxylic acid may be also used.

The lower alkyl ester is not particularly limited and may be appropriately selected depending on the intended purpose. Examples of the lower alkyl ester include methyl ester, ethyl ester, and isopropyl ester.

In the case where a mixture of the dicarboxylic acid and the trivalent or higher carboxylic acid are used, a mass ratio of the trivalent or higher carboxylic acid to the dicarboxylic acid is not particularly limited and may be appropriately selected depending on the intended purpose. The mass ratio is preferably from 0.01% by mass through 10% by mass and more preferably from 0.01% by mass through 1% by mass.

When the polyol and the polycarboxylic acid are allowed to proceed polycondensation, an equivalent ratio of hydroxyl groups of the polyol relative to carboxyl groups of the polycarboxylic acid is not particularly limited and may be appropriately selected depending on the intended purpose. The equivalent ratio is preferably from 1 through 2, more preferably from 1 through 1.5, and particularly preferably from 1.02 through 1.3.

An amount of the constitutional unit derived from polyol in the polyester prepolymer having an isocyanate group is not particularly limited and may be appropriately selected depending on the intended purpose. The amount is preferably from 0.5% by mass through 40% by mass, more preferably from 1% by mass through 30% by mass, and particularly preferably from 2% by mass through 20% by mass.

When the amount is less than 0.5% by mass, hot offset resistance reduces and it may be difficult to obtain both heat resistant storage stability and low-temperature fixing ability of the toner. When the amount is greater than 40% by mass, low-temperature fixing ability reduces.

—Polyisocyanate—

The polyisocyanate is not particularly limited and may be appropriately selected depending on the intended purpose. Examples of the polyisocyanate include aliphatic diisocyanate, alicyclic diisocyanate, aromatic diisocyanate, aromatic aliphatic diisocyanate, isocyanurates, and products where any of the above-listed polyisocyanates is blocked with a phenol derivative, oxime, caprolactam, etc.

The aliphatic diisocyanate is not particularly limited and may be appropriately selected depending on the intended purpose. Examples of the aliphatic diisocyanate include tetramethylene diisocyanate, hexamethylene diisocyanate, methyl 2,6-diisocyanatocaproate, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is not particularly limited and may be appropriately selected depending on the intended purpose. Examples of the alicyclic diisocyanate include isophorone diisocyanate and cyclohexylmethane diisocyanate.

The aromatic diisocyanate is not particularly limited and may be appropriately selected depending on the intended purpose. Examples of the aromatic diisocyanate include tolylene diisocyanate, diisocyanatodiphenyl methane, 1,5-naphthylenediisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

The aromatic aliphatic diisocyanate is not particularly limited and may be appropriately selected depending on the intended purpose. Examples of the aromatic aliphatic diisocyanate include $\alpha,\alpha,\alpha',\alpha'$-tetramethylxylylenediisocyanate.

The isocyanurates are not particularly limited and may be appropriately selected depending on the intended purpose. Examples of the isocyanurates include tris(isocyanatoalkyl) isocyanurate and tris(isocyanatocycloalkyl)isocyanurate. The above-listed examples may be used alone or in combination.

When the polyisocyanate and a polyester resin having a hydroxyl group are allowed to react, an equivalent ratio of isocyanate groups of the polyisocyanate relative to hydroxyl groups of the polyester resin is not particularly limited and may be appropriately selected depending on the intended purpose. The equivalent ratio is preferably from 1 through 5, more preferably from 1.2 through 4, and particularly preferably from 1.5 through 3. When the equivalent ratio is less than 1, offset resistance may be low. When the equivalent ratio is greater than 5, low-temperature fixing ability may be low.

An amount of the constitutional unit derived from polyisocyanate in the polyester prepolymer having an isocyanate group is not particularly limited and may be appropriately selected depending on the intended purpose. The amount is preferably from 0.5% by mass through 40% by mass, more preferably from 1% by mass through 30% by mass, and particularly preferably from 2% by mass through 20% by mass. When the amount is less than 0.5% by mass, hot offset resistance may be low. When the amount is greater than 40% by mass, low-temperature fixing ability may be low.

An average number of isocyanate groups included in one molecule of the polyester prepolymer having an isocyanate group is not particularly limited and may be appropriately selected depending on the intended purpose. The average number is preferably 1 or greater, more preferably from 1.2 through 5, and particularly preferably from 1.5 through 4. When the average number is less than 1, a molecular weight of a urea-modified polyester-based resin may become low, which may lead to low hot offset resistance.

A mass ratio of the polyester prepolymer having an isocyanate group to the polyester resin including 50 mol % or greater of a propylene oxide adduct of bisphenols in the polyvalent and having the predetermined hydroxyl value and acid value is not particularly limited and may be appropriately selected depending on the intended purpose. The mass ratio is preferably from 5/95 through 25/75 and more preferably from 10/90 through 25/75. When the mass ratio is less than 5/95, hot offset resistance may be low. When the mass ratio is greater than 25/75, low temperature fixing ability or glossiness of an image may be low.

—Charge-Controlling Agent—

The charge-controlling agent is not particularly limited and may be appropriately selected depending on the intended purpose. Examples of the charge-controlling agent include nigrosine-based dyes, triphenylmethane-based dyes, chrome-containing metal complex dyes, molybdic acid chelate pigments, rhodamine-based dyes, alkoxy-based amines, quaternary ammonium salts (including fluorine-modified quaternary ammonium salts), alkyl amides, phosphorous or phosphorus compounds, tungsten or tungsten compounds, fluorine-based active agents, metal salts of salicylic acid, and metal salts of salicylic acid derivatives. Specific examples of the charge-controlling agent include: BONTRON 03 that is a nigrosine dye, BONTRON P-51 that is a quaternary ammonium salt, BONTRON S-34 that is metal-containing azo dye, E-82 that is an oxynaphthoic acid-based metal complex, E-84 that is a salicylic acid-based metal complex, and E-89 that is a phenol-based condensate (all available from Orient Chemical Industries Co., Ltd.); TP-302 and TP-415 that are quaternary ammonium salt molybdenum complexes (both available from Hodogaya Chemical Co., Ltd.); LRA-901 and LR-147 that is a boron complex (both available from Japan Carlit Co., Ltd.); copper phthalocyanine; perylene; quinacridone; azo-pigments; and polymer-based compounds having a functional group, such as a sulfonic acid group, a carboxyl group, and a quaternary ammonium salt.

An amount of the charge controlling agent is not particularly limited and may be appropriately selected depending on the intended purpose. The amount is preferably from 0.1 parts by mass through 10 parts by mass and more preferably from 0.2 parts by mass through 5 parts by mass relative to 100 parts by mass of the toner. When the amount is greater than 10 parts by mass, charging ability of a resultant toner is excessively large, which may impair an effect of the charge-controlling agent, and as a result, an electrostatic suction force to a developing roller increases, which may cause low flowability of a developer or low image density. The above-listed charge-controlling agents may be melt-kneaded together with a master batch or a resin, followed by being dissolved or dispersed. Needless to say, the charge-controlling agents may be directly added to an organic solvent at the time of dissolving and dispersing. Alternatively, the charge-controlling agents may be fixed on surfaces of toner particles after the production of toner particles.

—External Additives—

Apart from oxide particles, inorganic particles or hydrophobicity-treated inorganic particles can be used in combination as the external additives. Inorganic particles having an average particle diameter of hydrophobicity-treated primary particles is preferably from 1 nm through 100 nm and more preferably from 5 nm through 70 nm.

Moreover, the external additives preferably include at least one type or more of inorganic particles whose average particle diameter of primary particles is 20 nm or smaller and at least one type or more of inorganic particles whose average particle diameter of primary particles is 30 nm or greater. Moreover, a specific surface area according to the BET method is preferably from 20 $m^2/g$ through 500 $m^2/g$.

The external additives are not particularly limited and may be appropriately selected depending on the intended purpose. Examples of the external additives include silica particles, hydrophobic silica, fatty acid metal salts (e.g., zinc stearate and aluminium stearate), metal oxides (e.g., titania, alumina, tin oxide, and antimony oxide), and fluoropolymers.

Preferable examples of the additives include hydrophobic-treated silica particles, hydrophobic-treated titania particles, hydrophobic-treated titanium oxide particles, and hydrophobic-treated alumina particles. Examples of the silica particles include R972, R974, RX200, RY200, R202, R805, and R812 (all available from Nippon Aerosil Co., Ltd.). Examples of the titania particles include P-25 (available from Nippon Aerosil Co., Ltd.), STT-30 and STT-65C-S (both available from Titan Kogyo, Ltd.), TAF-140 (available from Fuji Titanium Industry Co., Ltd.), and MT-150W, MT-500B, MT-600B, and MT-150A (all available from TAYCA CORPORATION).

Examples of the hydrophobic-treated titanium oxide particles include T-805 (available from Nippon Aerosil Co., Ltd.), STT-30A and STT-65S-S (both available from Titan Kogyo, Ltd.), TAF-500T and TAF-1500T (both available from Fuji Titanium Industry Co., Ltd.), MT-100S and MT-100T (both available from TAYCA CORPORATION), and IT-S (available from ISHIHARA SANGYO KAISHA, LTD.).

The hydrophobic-treated oxide particles, hydrophobic-treated silica particles, hydrophobic-treated titania particles, and the hydrophobic-treated alumina particles can be obtained by processing hydrophilic particles with a silane-coupling agent, such as methyl trimethoxy silane, methyl triethoxy silane, and octyl trimethoxy silane. Moreover, silicone oil-treated oxide particles and inorganic particles, both of which are obtained by processing inorganic particles with silicone oil, optionally with an application of heat, are also suitably used.

As the silicone oil, for example, dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, acryl or methacryl-modified silicone oil, α-methylstyrene-modified silicone oil, etc. can be used. Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among the above-listed examples, silica and titanium dioxide are particularly preferable.

An amount of the external additives is not particularly limited and may be appropriately selected depending on the intended purpose. The amount is preferably from 0.1% by mass through 5% by mass and more preferably from 0.3% by mass through 3% by mass relative to the toner.

An average particle diameter of primary particles of the inorganic particles is not particularly limited and may be appropriately selected depending on the intended purpose. The average particle diameter is preferably 100 nm or less and more preferably 3 nm or greater but 70 nm or less. When the average particle diameter is smaller than the above-mentioned range, the inorganic particles are embedded in toner particles and hence it is difficult to exhibit a function of the inorganic particles. When the average particle diameter is larger than the above-mentioned range, the inorganic particles may unevenly damage a surface of a photoconductor and hence the inorganic particles having such an average particle diameter are not preferable.

—Flowability-Improving Agent—

The flowability-improving agent is not particularly limited and may be appropriately selected depending on the intended purpose, as long as the flowability-improving agent is an agent capable of performing a surface treatment to increase hydrophobicity and preventing deteriorations in flowability and charging properties in high humidity. Examples of the flowability-improving agent include silane coupling agents, sililation agents, silane coupling agent having a fluoroalkyl group, organic titanate-based coupling agents, aluminium-based coupling agents, silicone oil, and modified silicone oil. It is particularly preferable that the silica or the titanium oxide be subjected to a surface treatment with the above-mentioned flowability-improving agent and used as hydrophobic silica or hydrophobic titanium oxide.

—Cleaning Improving Agent—

The cleaning improving agent is not particularly limited and may be appropriately selected depending on the intended purpose, as long as the cleaning improving agent is an agent that is added to the toner in order to remove a developer remained on a photoconductor or a primary transfer medium after transferring. Examples of the cleaning improving agent include: fatty acid (e.g. stearic acid) metal salts, such as zinc stearate and calcium stearate; and polymer particles produced by soap-free emulsion polymerization, such as polymethyl methacrylate particles and polystyrene particles. The polymer particles are preferably polymer particles having a relatively narrow particle size distribution. The polymer particles are preferably polymer particles having a volume average particle diameter of from 0.01 μm through 1 μm.

—Magnetic Material—

The magnetic material is not particularly limited and may be appropriately selected depending on the intended purpose. Examples of the magnetic material include iron powder, magnetite, and ferrite. Among the above-listed examples, a white magnetic material is preferable in view of a color tone.

An acid value of the toner is not particularly limited and may be appropriately selected depending on the intended purpose. The acid value is preferably from 0.5 mgKOH/g through 40 mgKOH/g in view of controlling low-temperature fixing ability (minimum fixing temperature), a hot offset onset temperature, etc. When the acid value is less than 0.5 mgKOH/g, an effect of improving dispersion stability during production owing to base cannot be obtained, an elongation reaction and/or a cross-linking reaction prone to progress in the case where the prepolymer is used, and therefore production stability may be low. When the acid value is greater than 40 mgKOH/g, in the case where prepolymer is used, an elongation reaction and/or a cross-linking reaction becomes insufficient and hot offset resistance may be low.

A glass transition temperature (Tg) of the toner is not particularly limited and may be appropriately selected depending on the intended purpose. A glass transition temperature (Tg1st) calculated from first heating in DSC measurement is preferably 45° C. or higher but lower than 65° C. and more preferably 45° C. or higher but 55° C. or lower. The above-mentioned range of the glass transition temperature (Tg1st) can lead to low-temperature fixing ability, heat resistant storage stability, and high durability. When the Tg1st is lower than 45° C., blocking inside a developing device or filming to a photoconductor may occur. When the Tg1st is 65° C. or higher, low-temperature fixing ability may be deteriorated.

Moreover, a glass transition temperature (Tg2nd) calculated from second heating in DSC measurement of the toner is preferably 20° C. or higher but lower than 40° C. When the Tg2nd is lower than 20° C., blocking inside a developing device or filming to a photoconductor may occur. When the Tg2nd is higher than 40° C., low-temperature fixing ability may be deteriorated.

A volume average particle diameter of the toner is not particularly limited and may be appropriately selected depending on the intended purpose. The volume average particle diameter is preferably 3 μm or greater but 7 μm or less. Moreover, a ratio of the volume average particle diameter to a number average particle diameter is preferably 1.2 or less. Moreover, the toner preferably includes a component having a volume average particle diameter of 2 μm or less in an amount of 1% by number or greater but 10% by number or less.

<Calculation Methods and Analysis Methods of Various Properties of Toner and Constitutional Components of Toner>

<<Sp Value>>

The SP value (solubility parameter) will be explained.

The SP value is also called a solubility parameter and is quantifies by what degree components are soluble to each other. The SP value is expressed by the square root of an attracting force between molecules, i.e., cohesive energy density (CED). Note that, the CED is a quantity of energy required for evaporate a volume of 1 mL.

In the present disclosure, calculation of the SP value can be performed using Formula (I) below according to the Fedors' method.

$$SP\text{ value(solubility parameter)}=(\text{CED value})^{1/2}=(E/V)^{1/2} \quad \text{Formula (I)}$$

In Formula (I) above, E is molecular cohesive energy (cal/mol) and V is a molecule volume ($cm^3$/mol), and E is represented by Formula (II) below and V is represented by Formula (III) below where Δei is evaporation energy of the atomic group and Δvi is a mole volume.

$$E=\Sigma\Delta ei \quad \text{Formula (II)}$$

$$V=\Sigma\Delta vi \quad \text{Formula (III)}$$

There are various methods for a calculation method of the SP value. In the present disclosure, the Fedors' method, which has been typically used, is used.

As the calculation method and various data of evaporation energy Δei of each atomic group and a mole volume Δvi, the data disclosed in "Basic theory of adhesion" (Minoru Imoto, published by Kobunshi Kankoukai, Chapter 5) is used.

For the data that is not disclosed in the literature above, such as —$CF_3$ group, moreover, R. F. Fedors, Polym. Eng. Sci. 14, 147(1974) is referred to.

For reference, in the case where the SP value represented by Formula (I) is converted into a unit of $(J/cm^3)^{1/2}$, the value is multiplied by 2.046, and in the case where the SP value is converted into the SI unit of $(J/m^3)^{1/2}$, the value is multiplied by 2,046.

When the amorphous polyester resin, the crystalline polyester resin, and the amorphous hybrid resin are each synthesized and mixed together, for example, the SP values of the amorphous polyester resin, the crystalline polyester resin, and the amorphous hybrid resin are easily calculated as described above.

It is generally difficult to calculate an SP value of a resin from a charging composition ratio, when a resin skeleton of the resin is changed by adding monomers in the middle of the polymerization. Moreover, it is generally a case where a composition of components included in the toner is unclear and it is difficult to calculate an SP value.

However, the calculation of an SP value according to the Fedors' method can be performed as long as types and a ratio of the monomers constituting the resin etc., are specified.

For example, the calculation of the SP value of the mixture of the amorphous polyester resin, the crystalline polyester resin, the amorphous hybrid resin, etc. can be performed by performing separation through GPC and analyzing each separated component according to the below-described analysis method.

Specifically, in GPC using tetrahydrofuran (THF) as a mobile phase, an eluate is subjected to fractionation by means of a fraction collector, a fraction corresponding to a part of a desired molecular weight is collected from a total area of an elution curve.

The collected elutes are concentrated and dried by an evaporator etc. and resultant solids are dissolved in a deuterated solvent, such as deuterated chloroform and deuterated THF, followed by measurement of $^1$H-NMR. From an integration ratio of each of element, a ratio of a constitutional monomer of the resin in the elution composition is calculated.

As another method, moreover, the elute is concentrated, followed by performing hydrolysis with sodium hydroxide etc., and the decomposition product is subjected to quantitative analysis through high performance liquid chromatography (HPLC) etc. to calculate a ratio of a constitutional monomer.

Calculation of an SP value according to the Fedors' method can be performed as long as types and a ratio of monomers constituting a resin can be specified. When types of monomers are specified by the analysis above, in the present disclosure, an SP value is obtained by adding a composition ratio of each monomer one by one from the highest ratio, and calculating from the monomer constitution when a sum reached 90 mol % of the total of the monomers (i.e., the remained monomers are not added for calculation of the SP value).

<<Component Analysis of Toner>>

An analysis method for analyzing the toner to calculate the SP value will be described.

First, 1 g of the toner is added to 100 mL and the resultant mixture is stirred for 30 minutes at 25° C. to obtain a solution, in which a soluble component is dissolved.

The resultant solution is filtered with a membrane filter having an opening size of 0.2 μm, to thereby obtain a THF soluble component in the toner.

Subsequently, the THF soluble component is dissolved in THF to prepare a sample for GPC measurement and the sample is injected into GPC used for measuring a molecular weight of each of the above-described resins.

Meanwhile, a fraction collector is disposed at an outlet of the elution of GPC to fraction the elute per the predetermined count. The elute is obtained per 5% in terms of the area ratio from the elute onset on the elution curve (rise of the curve).

Next, each eluted fraction, as a sample, in an amount of 30 mg is dissolved in 1 mL of deuterated chloroform. To the resultant solution, 0.05% by volume of tetramethylsilane (TMS) is added as a standard material.

A glass tube for NMR measurement having a diameter of 5 mm is charged with the solution and the integration is performed 128 times at a temperature of from 23° C. through 25° C. by means of a nuclear magnetic resonance spectrometer (JNM-AL400, available from JEOL Ltd.), to thereby obtain a spectrum.

The monomer composition and the component ratio of each of the amorphous polymer resin, Polyester resin A, and the amorphous hybrid resin included in the toner can be determined from a peak integration ratio of the obtained spectrum.

For example, an assignment of the peak is performed in the following manner and a component ratio of constitutional monomers is determined from each of the integration ratios.

For example, the assignment of the peak can be performed as follows.

Near 8.25 ppm: Derived from a benzene ring of trimellitic acid (one hydrogen atom)

From near 8.07 ppm through near 8.10 ppm: Derived from a benzene ring of terephthalic acid (4 hydrogen atoms)

From near 7.1 ppm through near 7.25 ppm: Derived from a benzene ring of bisphenol A (4 hydrogen atoms)

Near 6.8 ppm: Derived from a benzene ring of bisphenol A (4 hydrogen atoms) and derived from a double bond of fumaric acid (2 hydrogen atoms)

From near 5.2 ppm through near 5.4 ppm: derived from methane of a bisphenol A propylene oxide adduct (1 hydrogen atom)

From near 3.7 ppm through near 4.7 ppm: Derived from methylene of a bisphenol A propylene oxide adduct (2 hydrogen atoms) and derived from a methylene of a bisphenol A ethylene oxide adduct (4 hydrogen atoms)

Near 1.6 ppm: Derived from a methyl group of bisphenol A (6 hydrogen atoms)

From the results, the SP values of Polyester Resin A and the amorphous hybrid resin can be calculated according to Formula (I) above.

<<Measuring Methods of Acid Value and Hydroxyl Value>>

A hydroxyl value can be measured according to the method specified in JIS K0070-1966.

Specifically, first, a sample is precisely weight by 0.5 g in a 100 mL measuring flask. To the sample, 5 mL of an acetylation reagent. Next, the resultant mixture in the flask is heated for from 1 hour through 2 hours in a hot bath of 100±5° C., followed by removing the flask from the hot bath to naturally cool the mixture. To the mixture, water is further added. The resultant is shaken to decompose acetic anhydride. In order to completely decompose the acetic anhydride, next, the flask is again heated in the hot bath for 10 minutes or longer, followed by naturally cooling. Thereafter, the wall of the flask is sufficiently washed with an organic solvent.

Furthermore, a hydroxyl value is measured at 23° C. by means of an automatic potentiometric titrator DL-53 Titrator (available from METTLER TOLEDO) and electrodes DG113-SC (available from METTLER TOLEDO) and analyzed using analysis software LABX LIGHT VERSION 1.00.000. Note that, a mixed solvent of 120 mL of toluene and 30 mL of ethanol is used for calibration of the device.

The measuring conditions are as follows.

[Measuring Conditions]
Stir
Speed [%]: 25
Time Ed: 15
EQP titration
Titrant/Sensor
Titrant: $CH_3ONa$
Concentration [mol/L]: 0.1
Sensor: DG115
Unit of measurement: mV
Predispensing to volume
Volume [mL]: 1.0
Wait time [s]: 0
Titrant addition: Dynamic
dE(set) [mV]: 8.0
dV(min) [mL]: 0.03
dV(max) [mL]: 0.5
Measure mode: Equilibrium controlled
dE [mV]: 0.5
dt [s]: 1.0
t(min) [s]: 2.0
t(max) [s]: 20.0
Recognition
Threshold: 100.0
Steepest jump only: No
Range: No
Tendency: None
Termination
at maximum volume [mL]: 10.0
at potential: No
at slope: No
after number EQPs: Yes
n=1
comb. termination conditions: No
Evaluation
Procedure: Standard
Potential 1: No
Potential 2: No
Stop for reevaluation: No The acid value can be measured by the method according to JIS K0070-1992.

Specifically, first, 0.5 g of a sample (0.3 g in case of an ethyl acetate soluble component) is added to 120 mL of toluene, followed by stirring the resultant mixture for about 10 hours at 23° C. to dissolve the sample. Subsequently, 30 mL of ethanol is added to the resultant to prepare a sample solution. When the sample is not dissolved, a solvent, such as dioxane and tetrahydrofuran, is used. Moreover, an acid value is measured at 23° C. by means of an automatic potentiometric titrator, DL-53 TITRATOR (available from METTLER TOLEDO) and electrodes DG113-SC (available from METTLER TOLEDO), and an analysis is performed using analysis software LABX LIGHT VERSION 1.00.000. Note that, a mixed solvent of 120 mL of toluene and 30 mL of ethanol is used for calibration of the device.

The measuring conditions are identical to the above-described measuring conditions for the hydroxyl value.

An acid value can be measured in the manner described above. Specifically, the acid value is measured by performing titration with a 0.1 N sodium hydroxide/alcohol solution that has been standardized in advance and calculating an acid value from the titration amount according to the formula:

Acid value [mgKOH/g]=titration amount [mL]×$N$×56.1 [mg/mL]/sample mass [g] (with the proviso that $N$ is a factor of the 0.1 $N$ potassium hydroxide/alcohol solution)

<<Measuring Methods of Melting Point and Glass Transition Temperature (Tg)>>

A melting point and a glass transition temperature (Tg) associated with the present disclosure can be measured, for example, by a DSC system (differential scanning calorimeter) ("DSC-60," available from Shimadzu Corporation).

Specifically, a melting point and a glass transition temperature of a target sample can be measured in the following manner.

First, a sample container formed of aluminium is charged with about 5.0 mg of a target sample, the sample container is placed on a holder unit, and the holder unit is set in an electronic furnace. Subsequently, the sample is heated from 0° C. through 150° C. at a heating rate of 10° C./min in a nitrogen atmosphere. Thereafter, the sample is cooled from 150° C. through 0° C. at a cooling rate of 10° C./min, the sample is moreover heated to 150° C. at a heating rate of 10° C./min, and a DSC curve of the sample is measured by means of differential scanning calorimeter ("DSC-60," available from Shimadzu Corporation).

A DSC curve of first heating is selected from the obtained DSC curves using an analysis program "endothermic shoulder temperature" in the DSC-60 system and a glass transition temperature of the target sample for first heating can be determined. Moreover, a DSC curve of second heating is selected using "endothermic shoulder temperature" and a glass transition temperature of the target sample for second heating can be determined.

Moreover, a DSC curve of first heating is selected from the obtained DSC curves using an analysis program "endothermic peak temperature" in the DSC-60 system and a melting point of the target sample for first heating can be determined. Moreover, a DSC curve of second heating is selected using "endothermic peak temperature" and a melting point of the target sample for second heating can be determined.

In the present disclosure, a glass transition temperature of first heating is determined as Tg1st and a glass transition temperature of second heating is determined as Tg2nd when the toner is used as a target sample.

In the present disclosure, moreover, a melting point and Tg of second heating of each constitutional component are determined as a melting point and Tg of each target sample.

<<Measuring Method of Particle Size Distribution>>

For example, a volume average particle diameter (D4) of the toner, a number average particle diameter (Dn) of the toner, and the ratio thereof (D4/Dn) can be measured by means of COULTER COUNTER TA-II, COULTER MULTISIZER II etc. (both available from Beckman Coulter, Inc.). In the present disclosure, COULTER MULTISIZER II is used. A measurement method will be described hereinafter.

First, from 0.1 mL through 5 mL of a surfactant (preferably polyoxyethylene alkyl ether (nonionic surfactant)) is added as a dispersing agent to from 100 mL through 150 mL of an electrolyte aqueous solution. The electrolyte aqueous solution is a 1% by mass NaCl aqueous solution prepared by using a primary sodium chloride. For example, ISOTON-II (available from Beckman Coulter, Inc.) can be used. To the resultant, from 2 mg through 20 mg of a measurement sample is further added. The electrolyte aqueous solution, in which the sample has been suspended, is subjected to a dispersion treatment for from about 1 minute through about 3 minutes by means of an ultrasonic disperser. A volume and the number of the toner particles or toner in the resultant sample are measured by means of the measuring device using 100 μm aperture as the aperture, to calculate a volume distribution and a number distribution. A volume average particle diameter (D4) and a number average particle diameter (Dn) of the toner can be determined from the obtained distributions.

As channels, the following 13 channels are used: 2.00 μm or greater but less than 2.52 μm; 2.52 μm or greater but less than 3.17 μm; 3.17 μm or greater but less than 4.00 μm; 4.00 μm or greater but less than 5.04 μm; 5.04 μm or greater but less than 6.35 μm; 6.35 μm or greater but less than 8.00 μm; 8.00 μm or greater but less than 10.08 μm; 10.08 μm or greater but less than 12.70 μm; 12.70 μm or greater but less than 16.00 μm; 16.00 μm or greater but less than 20.20 μm; 20.20 μm or greater but less than 25.40 μm; 25.40 μm or greater but less than 32.00 μm; and 32.00 μm or greater but less than 40.30 μm. The target particles for the measurement are particles having the diameters of 2.00 μm or greater but less than 40.30 μm.

<Production Method of Toner>

A production method of the toner is not particularly limited and may be appropriately selected depending on the intended purpose. The toner is preferably granulated by dispersing an oil phase in an aqueous medium, where the oil phase includes at least the amorphous polyester resin, the crystalline polyester resin, the release agent, the amorphous hybrid resin, and the colorant.

As one example of such a production method of the toner, a dissolution suspension method known in the art is listed.

As another example of the production method of the toner, moreover, a method where toner base particles are formed while generating a product (may be referred to as an "adhesive base" hereinafter) generated through an elongation reaction and/or a cross-linking reaction between the active hydrogen group-containing compound and the polymer having a site that can react with the active hydrogen group-containing compound.

—Preparation of Aqueous Medium (Aqueous Phase)—

For example, preparation of the aqueous medium can be performed by dispersing resin particles in an aqueous medium. An amount of the resin particles added into the aqueous medium is not particularly limited and may be appropriately selected depending on the intended purpose. The amount is preferably from 0.5% by mass through 10% by mass. The resin particles are not particularly limited and may be appropriately selected depending on the intended purpose. Examples of the resin particles include surfactants, poorly water-soluble inorganic compound dispersants, and polymer-based protective colloids. The above-listed examples may be used alone or in combination. Among the above-listed examples, surfactants are preferable.

The aqueous medium is not particularly limited and may be appropriately selected depending on the intended purpose. Examples of the aqueous medium include water, solvents miscible with water, and mixtures of water and the solvents miscible with water. The above-listed examples may be used alone or in combination.

Among the above-listed examples, water is preferable.

The solvent miscible with water is not particularly limited and may be appropriately selected depending on the intended purpose. Examples of the solvent miscible with water include alcohols, dimethylformamide, tetrahydrofuran, cellosolves, and lower ketones. The alcohols are not particularly limited and may be appropriately selected depending on the intended purpose. Examples of the alcohols include methanol, isopropanol, and ethylene glycol. The lower ketones are not particularly limited and may be appropriately selected depending on the intended purpose. Examples of the lower ketones include acetone and methylethylketone.

—Preparation of Oil Phase—

Preparation of the oil phase including toner material can be performed by dissolving or dispersing toner materials in an organic solvent, where the toner materials include the active hydrogen group-containing compound, a polymer having a site that can react with the active hydrogen group-containing compound, Polyester Resin A, the amorphous polyester resin, the release agent, the amorphous hybrid resin, and the colorant.

The organic solvent is not particularly limited and may be appropriately selected depending on the intended purpose. In view of easiness of removal, the organic solvent is preferably an organic solvent having a boiling point of lower than 150° C.

The organic solvent having a boiling point of lower than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, ethyl acetate, ethyl acetate, methyl ethyl ketone, and methyl isobutyl ketone. The above-listed examples may be used alone or in combination.

Among the above-listed examples, ethyl acetate, toluene, xylene, benzene, methylene chloride, 1,2-dichloroethane, chloroform, carbon tetrachloride, etc. are preferable, and ethyl acetate is more preferable.

—Emulsifying or Dispersing—

Emulsification or dispersion of the toner particles can be performed by dispersing the oil phase including the toner materials in the aqueous medium. When the toner materials are emulsified or dispersed, the active hydrogen group-containing compound and the polymer having a site that can react with the active hydrogen group-containing compound are allowed to react through an elongation reaction and/or a cross-linking reaction, to thereby generate an adhesive base.

For example, the adhesive base may be generated by emulsifying or dispersing an oil phase including a polymer reactive to an active hydrogen group (e.g., polyester prepolymer having an isocyanate group) together with a compound including an active hydrogen group (e.g., amines) in an aqueous medium and allowing the both to react through an elongation reaction and/or a cross-linking reaction in the aqueous medium. Alternatively, the adhesive base may be generated by emulsifying or dispersing an oil phase including the toner materials in an aqueous medium, to which a compound having an active hydrogen group has been added in advance and allowing the both to react through an elongation reaction and/or a cross-linking reaction in the aqueous medium. Alternatively, the adhesive base may be generated by emulsifying or dispersing an oil phase including the toner materials in an aqueous medium, followed by adding a compound having an active hydrogen group to the resultant, and allowing the both to react from interfaces of particles through an elongation reaction and/or a cross-linking reaction in the aqueous medium. When the both are reacted from the interfaces of the particles through an elongation reaction and/or a cross-linking reaction, a urea-modified polyester resin is formed predominantly at a surface of toner to be generated and therefore it is possible to give a concentration deviation of the urea-modified polyester resin in the toner.

The reaction conditions (reaction time and a reaction temperature) for generating the adhesive base are not particularly limited and may be appropriately selected depending on a combination of the active hydrogen group-containing compound and the polymer having a site that can react with the active hydrogen group-containing compound.

The reaction time is not particularly limited and may be appropriately selected depending on the intended purpose. The reaction time is preferably from 10 minutes through 40 hours and more preferably from 2 hours through 24 hours.

The reaction temperature is not particularly limited and may be appropriately selected depending on the intended purpose. The reaction temperature is preferably from 0° C. through 150° C. and more preferably from 40° C. through 98° C.

A method for stably forming, in the aqueous medium, a dispersion liquid including a polymer having a site that can react with an active hydrogen group-containing compound (e.g., polyester prepolymer having an isocyanate group) is not particularly limited and may be appropriately selected depending on the intended purpose. Examples of the method include a method where an oil phase prepared by dissolving or dispersing the toner materials in a solvent is added to an aqueous medium phase and the resultant mixture is dispersed by a shearing force.

A disperser for the dispersing is not particularly limited and may be appropriately selected depending on the intended purpose. Examples of the disperser include low-speed shearing dispersers, high-speed shearing dispersers, friction dispersers, high-pressure jetting dispersers, and ultrasonic wave dispersers.

Among the above-listed examples, a high-speed shearing disperser is preferable because particle diameters of dispersed elements (oil droplets) can be controlled to the range of from 2 μm through 20 μm.

In a case where the high-speed shearing disperser is used, conditions, such as the number of revolutions, dispersion time, and a dispersion temperature, can be appropriately selected depending on the intended purpose.

The number of revolutions is not particularly limited and may be appropriately selected depending on the intended purpose. The number of revolutions is preferably from 1,000 rpm through 30,000 rpm and more preferably from 5,000 rpm through 20,000 rpm.

The dispersion time is not particularly limited and may be appropriately selected depending on the intended purpose. In case of a batch system, the dispersion time is preferably from 0.1 minutes through 5 minutes.

The dispersion temperature is not particularly limited and may be appropriately selected depending on the intended purpose. The dispersion temperature is preferably from 0° C. through 150° C. and more preferably from 40° C. through 98° C. under the pressure. Generally speaking, it is easier to disperse when the dispersion temperature is higher.

An amount of the aqueous medium used for emulsifying and/or dispersing the toner materials is not particularly limited and may be appropriately selected depending on the intended purpose. The amount is preferably from 50 parts by mass through 2,000 parts by mass and more preferably from 100 parts by mass through 1,000 parts by mass relative to 100 parts by mass of the toner materials.

When the amount of the aqueous medium is less than 50 parts by mass, the dispersion state of the toner materials is poor and toner base particles having the predetermined particle diameters may not be able to obtain. When the amount thereof is greater than 2,000 parts by mass, a production cost may become high.

When the oil phase including the toner materials is emulsified or dispersed, a dispersing agent is preferably used in order to stabilize dispersed elements, such as oil droplets, form desired shapes of the dispersed elements, and make a particle size distribution sharp.

The dispersing agent is not particularly limited and may be appropriately selected depending on the intended purpose. Examples of the dispersing agent include surfactants, poorly water-soluble inorganic compound dispersing agents, and polymer-based protective colloid. The above-listed examples may be used alone or in combination.

Among the above-listed examples, a surfactant is preferable.

The surfactant is not particularly limited and may be appropriately selected depending on the intended purpose. For example, an anionic surfactant, a cationic surfactant, a nonionic surfactant, an amphoteric surfactant, etc., can be used.

The anionic surfactant is not particularly limited and may be appropriately selected depending on the intended purpose. Examples of the anionic surfactant include alkylbenzenesulfonic acid salts, α-olefin sulfonic acid salts, and phosphoric acid esters.

Among the above-listed examples, a surfactant including a fluoroalkyl group is preferable.

A catalyst can be used for an elongation reaction and/or a cross-linking reaction when the adhesive base is generated.

The catalyst is not particularly limited and may be appropriately selected depending on the intended purpose. Examples of the catalyst include dibutyl tin laurate and dioctyl tin laurate.

—Removal of Organic Solvent—

A method for removing the organic solvent from the dispersion liquid, such as the emulsified slurry, is not particularly limited and may be appropriately selected depending on the intended purpose. Examples of the method include: a method where an entire reaction system is gradually heated to evaporate an organic solvent in oil droplets; and a method where a dispersion liquid is sprayed in a dry atmosphere to remove an organic solvent in oil droplets.

Once the organic solvent is removed, toner base particles are formed. Washing, drying, etc. can be performed on the toner base particles. Classification etc. can be further performed. The classification can be performed by removing the fine particle component by means of a cyclone, a decanter, a centrifugal separator, etc. in a liquid. Alternatively, the classification may be performed after drying toner base particles.

The obtained toner base particles may be mixed with particles, such as the external additives and the charge-controlling agent. During the mixing, a mechanical impact may be applied to prevent the particles, such as the external additives, from dropping off from the surfaces of the toner base particles.

A method for applying the mechanical impact is not particularly limited and may be appropriately selected depending on the intended purpose. Examples of the method include: a method where an impact is applied to a mixture using a blade rotating at high speed; and a method where a mixture is added in a high-speed air flow to accelerate to allow the particles to collide against one another or to allow the particles to crush into an appropriate collision plate.

A device used for the above-mentioned method is not particularly limited and may be appropriately selected depending on the intended purpose. Examples of the device include ANGMILL (available from Hosokawa Micron Corporation), an apparatus produced by modifying I-TYPE mill (available from Nippon Pneumatic Mfg. Co., Ltd.) to reduce the pulverizing air pressure thereof, a hybridization system (available from Nara Machinery Co., Ltd.), a KRYPTRON system (available from Kawasaki Heavy Industries, Ltd.) and an automatic mortar.

(Developer)

A developer of the present disclosure includes at least the toner and may further include other components, such as a carrier, according to the necessity.

Therefore, transfer properties, charging properties, etc. are excellent and a high quality image can be formed stably. Note that, the developer may be a one-component developer or a two-component developer. When the developer is used for a high-speed printer corresponding to current information-processing speed, etc., the developer is preferably a two-component developer because a service life can be improved.

In the case where the developer is used as a one-component developer, the diameters of particles of the toner do not vary largely even when the toner is balanced, the toner does not cause filming to a developing roller nor fuse to a layer thickness regulating member, such as a blade for thinning a layer of the toner, and excellent and stable developing ability and images are obtained even when the developer is stirred in the developing unit over a long period of time.

In the case where the developer is used as a two-component developer, the diameters of particles of the toner do not vary largely even when the toner is balanced and excellent and stable developing ability and images are obtained even when the developer is stirred in the developing unit over a long period of time.

When the toner is used for a two-component developer, the toner can be used by mixing with the carrier. An amount of the carrier in the two-component developer is not particularly limited and may be appropriately selected depending on the intended purpose. The amount is preferably from 90% by mass through 98% by mass and more preferably from 93% by mass through 97% by mass.

<Carrier>

The carrier is not particularly limited and may be appropriately selected depending on the intended purpose. The carrier is preferably a carrier including cores and a resin layer covering each core.

—Cores—

A material of the cores is not particularly limited and may be appropriately selected depending on the intended purpose. Examples of the material include manganese-strontium-based materials of from 50 emu/g through 90 emu/g and manganese-magnesium-based materials of from 50 emu/g through 90 emu/g. In order to assure image density, use of a high magnetic material, such as iron powder of 100 emu/g or greater and magnetite of from 75 emu/g through 120 emu/g, is preferable. Moreover, a weak magnetic material, such as a copper-zinc-based material of 30 emu/g through 80 emu/g, is preferable because resulting carrier can reduce an impact of the developer held in the form of a brush against a photoconductor and it is advantageous for forming high quality images.

The above-listed examples may be used alone or in combination.

A volume average particle diameter of the cores is not particularly limited and may be appropriately selected depending on the intended purpose. The volume average particle diameter is preferably from 10 μm through 150 μm and more preferably from 40 μm through 100 μm. When the volume average particle diameter is less than 10 μm, an amount of fine powder increases in the carrier and magnetization per particle reduces to cause scattering of the carrier. When the volume average particle diameter is greater than 150 μm, a specific surface area of the cores reduces to cause scattering of the toner and therefore reproducibility of a solid image area may be impaired, particularly in the case of a full color image having many solid image areas.

—Resin Layer—

A material of the resin layer is not particularly limited and may be appropriately selected from resins known in the art depending on the intended purpose. Examples of the material include amino-based resins, polyvinyl-based resins, polystyrene-based resins, halogenated polyolefin, polyester-based resins, polycarbonate-based resins, polyethylene, polyvinyl fluoride, polyvinylidene fluoride, polytrifluoroethylene, polyhexafluoropropylene, vinylidene fluoride-acryl monomer copolymers, vinylidene fluoride-vinyl fluoride copolymers, fluoroterpolymers, such as copolymers of tetrafluoroethylene, vinylidene fluoride, and a monomer having no fluorogroup, and silicone resins.

The above-listed examples may be used alone or in combination.

The amino-based resin is not particularly limited and may be appropriately selected depending on the intended purpose. Examples of the amino-based resin include urea-formaldehyde resins, melamine resins, benzoguanamine resins, urea resins, polyamide resins, and epoxy resins.

The polyvinyl-based resins are not particularly limited and may be appropriately selected depending on the intended purpose. Examples of the polyvinyl-based resins include acryl resins, methyl polymethacrylate, polyacrylonitrile, polyvinyl acetate, polyvinyl alcohol, and polyvinyl butyral.

The polystyrene-based resins are not particularly limited and may be appropriately selected depending on the intended purpose. Examples of the polystyrene-based resins include polystyrene and styrene-acryl copolymers.

The hydrogenated polyolefin is not particularly limited and may be appropriately selected depending on the intended purpose. Examples of the hydrogenated polyolefin include polyvinyl chloride.

The polyester-based resins are not particularly limited and may be appropriately selected depending on the intended purpose. Examples of the polyester-based resins include polyethylene terephthalate and polybutylene terephthalate.

The resin layer may include conductive powder etc., according to the necessity. The conductive powder is not particularly limited and may be appropriately selected depending on the intended purpose. Examples of the conductive powder include metal powder, carbon black, titanium oxide, tin oxide, and zinc oxide. An average particle diameter of the conductive powder is preferably 1 μm or less. When the average particle diameter is greater than 1 μm, it may be difficult to control electric resistance.

The resin layer can be formed by dissolving a silicone resin etc., in a solvent to prepare a coating liquid, applying the coating liquid to surfaces of cores according to a coating method known in the art, drying the coating liquid, and baking.

The coating method is not particularly limited and may be appropriately selected depending on the intended purpose. For example, dip coating, spraying, brush coating, etc. can be used.

The solvent is not particularly limited and may be appropriately selected depending on the intended purpose. Examples of the solvent include toluene, xylene, methyl ethyl ketone, methyl isobutyl ketone, and butyl acetate cellosolve.

The baking may be performed by an external heating system or an internal heating system. Examples thereof include a method where a fixed-type electric furnace, a flow-type electric furnace, a rotary electric furnace, a burner furnace, etc., are used, and a method where microwaves are used.

An amount of the resin layer in the carrier is not particularly limited and may be appropriately selected depending on the intended purpose. The amount is preferably from 0.01% by mass through 5.0% by mass. When the amount is less than 0.01% by mass, a uniform resin layer may not be formed on a surface of the core. When the amount is greater than 5.0% by mass, resultant carrier particles may fuse to one another because the resin layers are thick and therefore the resultant carrier has low uniformity.

(Toner-Stored Unit)

The toner-stored unit according to the present disclosure is a unit having a function of storing a toner, where the unit stores therein the toner. Examples of embodiments of the toner-stored unit include toner-stored containers, developing devices, and process cartridge.

The toner-stored container is a container that stores therein a toner.

The developing device is a developing device including a unit configured to store a toner and to perform developing.

The process cartridge includes an integration of at least an image bearer and a developing unit, stores therein a toner, and is detachably mounted in an image forming apparatus. The process cartridge may further include at least one selected from the group consisting of a charging unit, an exposing unit, and a cleaning unit.

Next, one embodiment of the process cartridge is illustrated in FIG. 1. As illustrated in FIG. 1, the process cartridge of the present embodiment has a latent image-bearer 101 built therein, including a charging device 102, a developing device 104, and a cleaning unit 107, and may further include other units according to the necessity. In FIG. 1, the reference numeral 103 denotes exposure light from an exposing device and the reference numeral 105 denotes recording paper.

As the latent image-bearer 101, a latent image-bearer identical to an electrostatic latent image-bearer in a below-described image forming apparatus can be used. Moreover, an appropriate charging member is used for the charging device 102.

According to an image forming process performed by the process cartridge illustrated in FIG. 1, the latent image-bearer 101 is charged by the charging device 102 and exposed to exposure light 103 by an exposing unit (not illustrated) with rotating in the direction indicated with the arrow to thereby form an electrostatic latent image, which corresponds to the exposure image, on a surface of the latent image-bearer 101.

The electrostatic latent image is developed by the developing device 104 and the toner development is transferred to recording paper 105 by the transfer roller 108, followed by printing out. Subsequently, the surface of the latent image-bearer after the image transfer is cleaned by the cleaning unit 107 and the charge thereof is eliminated by the charge-eliminating unit (not illustrated). Then, the above-mentioned operations are repeated again.

Image formation is performed using the toner of the present disclosure when image formation is performed by mounting the toner-stored unit of the present disclosure in an image forming apparatus. The toner-stored unit storing the toner having excellent low-temperature fixing ability, hot offset resistance, stress resistance, and heat resistant storage stability without causing filming can be obtained.

(Image Forming Method and Image Forming Apparatus)

An image forming apparatus of the present disclosure includes at least an electrostatic latent image-bearer (may be referred to as a "photoconductor" hereinafter), an electrostatic latent image-forming unit, and a developing unit. The image forming apparatus may further include other units, such as a charge-eliminating unit, a cleaning unit, a recycling unit, and a controlling unit.

An image forming method of the present disclosure includes at least an electrostatic latent image forming step and a developing step. The image forming method may further include other steps, such as a charge-eliminating step, a cleaning step, a recycling step, and a controlling step.

The image forming method is suitably performed by the image forming apparatus. The electrostatic latent image forming step is suitably performed by the electrostatic latent image-forming unit. The developing step is suitably performed by the developing unit. The other steps are suitably performed by the other units.

—Electrostatic Latent Image Forming Step and Electrostatic Latent Image-Forming Unit—

The electrostatic latent image forming step is a step including forming an electrostatic latent image on an electrostatic latent image-bearer.

A material, shape, structure, size, etc. of the electrostatic latent image-bearer (may be also referred to as am "electrophotographic photoconductor" and a "photoconductor") are not particularly limited and may be appropriately selected from materials, shapes, structures, sizes, etc. known in the art. Preferable examples of the shape include a drum shape. Examples of the material include: inorganic photoconductors, such as amorphous silicon and selenium; and organic photoconductors (OPC), such as polysilane and phthalopolymethine. Among the above-listed examples, organic photoconductors (OPC) are preferable because an image of the higher definition can be obtained.

For example, formation of the electrostatic latent image can be performed by uniformly charging a surface of the electrostatic latent image-bearer, followed by exposing the surface to light imagewise. The formation of the electrostatic latent image can be performed by the electrostatic latent image-forming unit.

For example, the electrostatic latent image-forming unit includes at least a charging unit (charger) configured to uniformly charge a surface of the electrostatic latent image-bearer and an exposing unit (exposure device) configured to expose the surface of the electrostatic latent image-bearer to light imagewise.

For example, the charging can be performed by applying voltage to the surface of the electrostatic latent image-bearer using the charger.

The charger is not particularly limited and may be appropriately selected depending on the intended purpose. Examples of the charger include contact chargers, known in the art as themselves, equipped with conductive or semi-conductive rollers, brushes, films, rubber blades, etc., and non-contact chargers utilizing corona discharge, such as corotron and scorotron.

The charger is a charger that is disposed in contact with or without contact with an electrostatic latent image-bearer and is configured to apply superimposed direct and alternating voltage to charge a surface of the electrostatic latent image-bearer.

Moreover, the charger is preferably a charging roller that is disposed near the electrostatic latent image-bearer via a gap tape without being contact with the electrostatic latent image-bearer and a surface of the electrostatic latent image-bearer by applying superimposed direct and alternating voltage to the charging roller.

For example, the exposure can be performed by exposing the surface of the electrostatic latent image-bearer to light imagewise using the exposing device.

The exposing device is not particularly limited and may be appropriately selected depending on the intended purpose, as long as the exposing device is capable of exposing the charged electrostatic latent image-bearer charged by the charger to light corresponding to an image to be formed. Examples of the exposing device include various exposing devices, such as reproduction optical exposing devices, rod-lens array exposing devices, laser optical exposing devices, and liquid crystal shutter optical exposing devices.

Note that, in the present disclosure, a back light system where imagewise exposure is performed from a back side of the electrostatic latent image-bearer.

—Developing Step and Developing Unit—

The developing step is a step including developing the electrostatic latent image with the toner to form a visible image.

For example, formation of the visible image can be performed by developing the electrostatic latent image with the toner. The formation of the visible image can be performed by the developing unit.

For example, the developing unit is preferably a developing unit including at least a developing device that stores therein the toner and is capable of applying the toner to the electrostatic latent image with the direct contact or indirect contact. The developing unit is more preferably a developing device including a toner-stored container etc.

The developing device may be a developing device for a single color or a developing device for multiple colors. Preferable examples of the developing device include a developing device including a stirrer configured to stir the toner to friction charge the toner and a rotatable magnetic roller.

Inside the developing device, for example, the toner and the carrier are mixed and stirred together to charge the toner due to frictions caused during the stirring. The charged toner is held on a surface of the rotating magnet roller in the form of a brush to form a magnetic brush. Since the magnet roller is disposed near the electrostatic latent image-bearer (photoconductor), part of the toner constituting the magnetic brush formed on the surface of the magnet roller is moved onto a surface of the electrostatic latent image-bearer (photoconductor) by electric suction force. As a result, the electrostatic latent image is developed with the toner to form a visible image formed of the toner on the surface of the electrostatic latent image-bearer (photoconductor).

—Transferring Step and Transferring Unit—

The transferring step is a step including transferring the visible image to a recording medium. A preferable embodiment is that an intermediate transfer member is used and a visible image is primary transferred to the intermediate transfer member, followed by secondary transferring the visible image to the recording medium. A more preferable embodiment is that toners of two or more colors, preferably full-color toners are used as the toner, and a primary transferring step including transferring visible images on the intermediate transfer member to form a composite transfer image and a secondary transferring step including transferring the composite transfer image onto a recording medium are included.

For example, the transferring can be performed by charging the visible image on the electrostatic image-bearer (photoconductor) using a transfer charger. The transferring can be performed by means of the transferring unit. As a preferable embodiment, the transferring unit includes a primary transferring unit configured to transfer visible images onto an intermediate transfer member to form a composite transfer image and a secondary transferring unit configured to transfer the composite transfer image onto a recording medium.

Note that, the intermediate transfer member is not particularly limited and may be appropriately selected from transfer members known in the art depending on the intended purpose. Preferable examples of the intermediate transfer member include transfer belts.

The transferring unit (the primary transferring unit or the secondary transferring unit) preferably includes at least a transferring device configured to charge and remove the visible image formed on the electrostatic latent image-bearer (photoconductor) to the side of the recording medium. The number of the transferring unit(s) disposed may be 1 or 2 or more.

Examples of the transferring device include corona transferring devices using corona discharge, transfer belts, transfer roller, pressure transfer rollers, and adhesion transferring devices.

Note that, the recording medium is not particularly limited and may be appropriately selected from recording media (recording paper) known in the art.

—Fixing Step and Fixing Unit—

The fixing step is a step including fixing the visible image transferred onto the recording medium using a fixing device. The fixing step may be performed every time the visible image of each color of the developer is transferred onto the recording medium. Alternatively, the fixing step may be performed once in the state where the visible images of all of the colors of the developers are laminated.

The fixing device is not particularly limited and may be appropriately selected depending on the intended purpose. The fixing device is preferably a heat pressure member known in the art. Examples of the heat pressure member include a combination of a heating roller and a pressure roller and a combination of a heat roller, a pressure roller, and an endless belt.

The fixing device is preferably a unit that includes a heating body equipped with a heater, a film in contact with the heating body, and a pressure member pressing against the heating body via the film and is configured to pass a recording medium on which an unfixed image is formed between the film and the pressure member to heat and fix the image. The heating performed by the heat pressure member is typically preferably performed at a temperature from 80° C. through 200° C.

Note that, in the present disclosure, for example, an optical fixing device may be used together with or instead of the fixing step and the fixing unit depending on the intended purpose.

The charge-eliminating step is a step including applying charge-eliminating bias to the electrostatic latent image-bearer to eliminate the charge. The charge-eliminating step can be suitably performed by the charge-eliminating unit.

The charge-eliminating unit is not particularly limited as long as the charge-eliminating unit is capable of applying charge-eliminating bias to the electrostatic latent image-bearer. The charge-eliminating unit may be appropriately selected from charge eliminators known in the art. Preferable examples of the charge-eliminating unit include charge-eliminating lamps.

The cleaning step is a step including removing the toner remained on the electrostatic latent image-bearer. The cleaning step is suitably performed by a cleaning unit.

The cleaning unit is not particularly limited as long as the cleaning unit is capable of removing the toner remained on the electrostatic latent image-bearer. The cleaning unit may be appropriately selected from cleaners known in the art. Preferable examples of the cleaning unit include magnetic brush cleaners, electrostatic brush cleaners, magnetic roller cleaners, blade cleaners, brush cleaners, and web cleaners.

The recycling step is a step including recycling the toner removed in the cleaning step to the developing unit. The recycling step is suitably performed by a recycling unit. The recycling unit is not particularly limited. Examples of the recycling unit include conveying units known in the art.

The controlling step is a step including controlling each of the above-mentioned steps. The controlling step is suitably performed by a controlling unit.

The controlling unit is not particularly limited and may be appropriately selected depending on the intended purpose, as long as the controlling unit is capable of controlling operations of each of the above-mentioned units. Examples of the controlling unit include devices, such as sequencers and computers.

Figure 2:
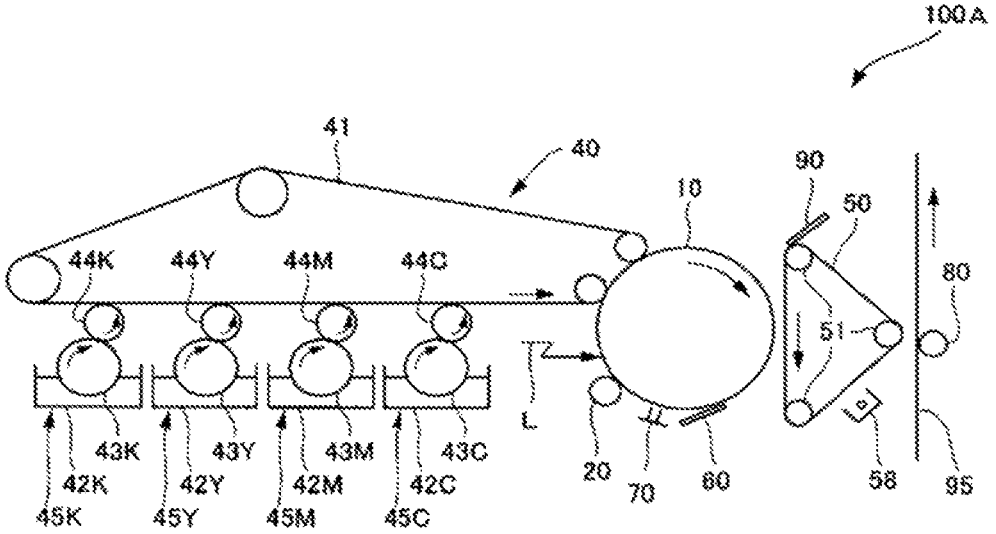
FIG. 2 is a schematic view illustrating one example of an image forming apparatus of the present disclosure.

A first example of the image forming apparatus of the present disclosure is illustrated in FIG. 2. The image forming apparatus 100A includes a photoconductor drum 10, a charging roller 20, an exposing device, a developing device 40, an intermediate transfer belt 50, a cleaning device 60 having a cleaning blade, and a charge-eliminating lamp 70.

The intermediate transfer belt 50 is an endless belt supported by three rollers 51 disposed inner side thereof and can be rotated in the direction indicated with the arrow in FIG. 2. Part of the three rollers 51 can also function as transfer bias rollers capable of applying transfer bias (primary transfer bias) to the intermediate transfer belt 50. Moreover, a cleaning device 90 having a cleaning blade is disposed near the intermediate transfer belt 50. Furthermore, a transfer roller 80 capable of applying transfer bias (secondary transfer bias) for transferring a toner image to transfer paper 95 is disposed to face the intermediate transfer belt 50.

At the periphery of the intermediate transfer belt 50, moreover, a corona charging device 58 configured to apply a charge to the toner image transferred to the intermediate transfer belt 50 is disposed in an area between a contact area of the photoconductor drum 10 with the intermediate transfer belt 50 and a contact area of the intermediate transfer belt 50 with the transfer paper 95 relative to the rotational direction of the intermediate transfer belt 50.

The developing device 40 includes a developing belt 41, and a black developing unit 45K, a yellow developing unit 45Y, a magenta developing unit 45M, and a cyan developing unit 45C disposed together at the periphery of the developing belt 41. Note that, the developing unit 45 of each color includes a developer-stored unit 42, a developer supply roller 43, and a developing roller (developer bearer) 44. Moreover, the developing belt 41 is an endless belt supported by a plurality of belt rollers and can be rotated in the direction indicated with the arrow in FIG. 2. Furthermore, part of the developing belt 41 is in contact with the photoconductor drum 10.

Next, a method for forming an image using the image forming apparatus 100A will be explained. First, a surface of the photoconductor drum 10 is uniformly charged by the charging roller 20, and then the photoconductor drum 10 is exposed to exposure light L by means of an exposing device (not illustrated) to form an electrostatic latent image. Next, the electrostatic latent image formed on the photoconductor drum 10 is developed with a toner supplied from the developing device 40, to thereby form a toner image. Moreover, the toner image formed on the photoconductor drum 10 is transferred (primary transferred) onto the intermediate transfer belt 50 by transfer bias applied from the roller 51 and then the toner image is transferred (secondary transferred) onto transfer paper 95 by transfer bias applied from the transfer roller 80. Meanwhile, the toner remained on the surface of the photoconductor drum 10, from which the toner image has been transferred to the intermediate transfer belt 50, is removed by the cleaning device 60, followed by eliminating the charge of the photoconductor drum 10 with the charge-eliminating lamp 70.

Figure 3:
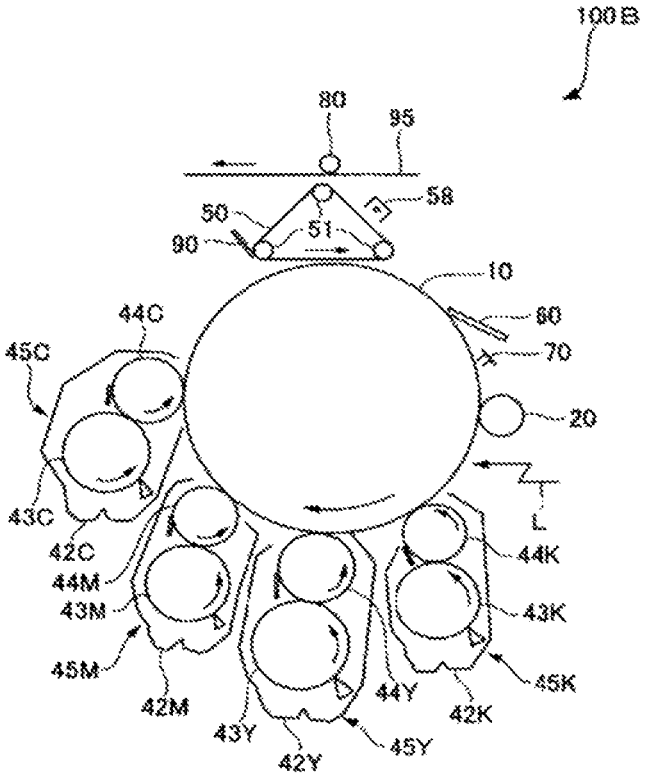
FIG. 3 is a schematic view illustrating another example of the image forming apparatus of the present disclosure.

A second example of the image forming apparatus for use in the present disclosure is illustrated in FIG. 3. The image forming apparatus 100B has the same structure to that of the image forming apparatus 100A, except that a black developing unit 45K, a yellow developing unit 45Y, a magenta developing unit 45M, and a cyan developing unit 45C are disposed at the periphery of the photoconductor drum 10 to directly face the photoconductor drum 10 without disposing the developing belt.

Figure 4:
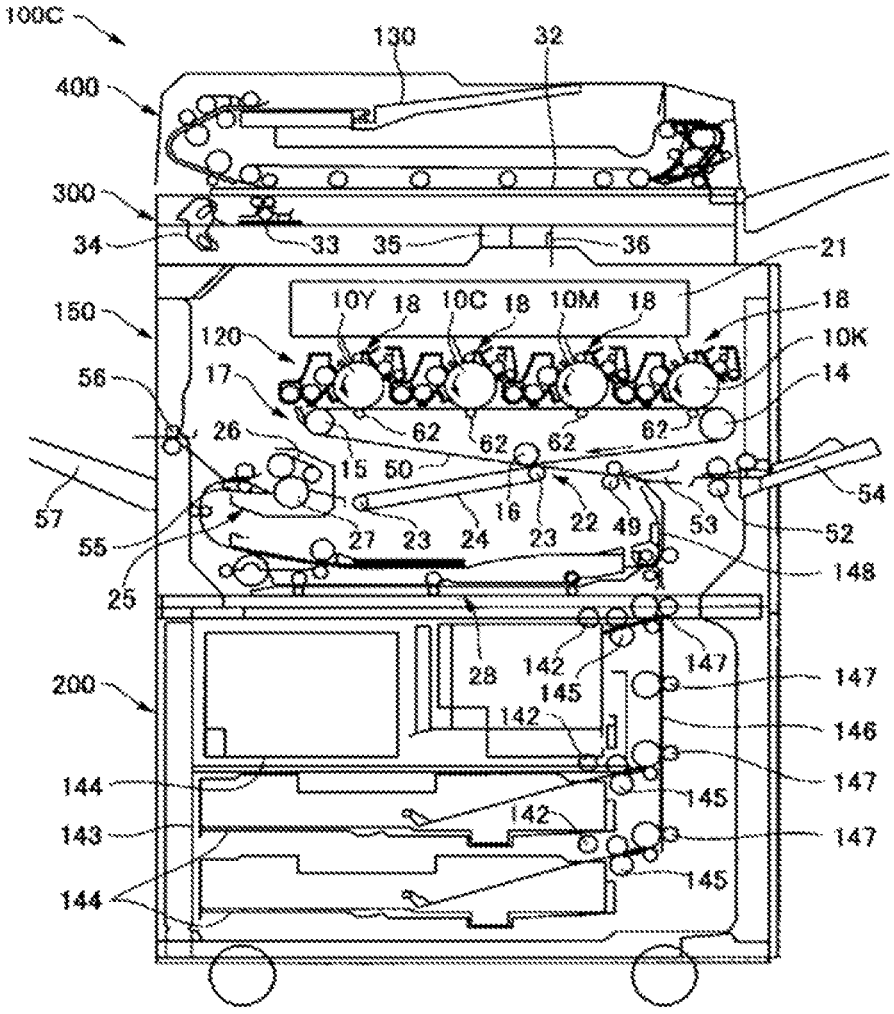
FIG. 4 is a schematic view illustrating another example of the image forming apparatus of the present disclosure.

A third example of the image forming apparatus for use in the present disclosure is illustrated in FIG. 4. The image forming apparatus 100C is a tandem color image forming apparatus. The image forming apparatus 100C includes a copier main body 150, a paper feeding table 200, a scanner 300, and an automatic document feeder (ADF) 400.

An intermediate transfer belt 50 disposed in the central part of the copier main body 150 is an endless belt supported by three rollers 14, 15, and 16 and can be rotated in the direction indicated with the arrow in FIG. 4. A cleaning device 17 having a cleaning blade for removing the toner remained on the intermediate transfer belt 50 from which a toner image has been transferred to recording paper is disposed near the roller 15. Yellow, cyan, magenta, and black image-forming units 120Y, 120C, 120M, and 120K are aligned and disposed along the traveling direction of the intermediate transfer belt 50 to face a section of the intermediate transfer belt 50 supported by the rollers 14 and 15.

Moreover, an exposing device 21 is disposed near the image-forming unit 120. Furthermore, a secondary transfer belt 24 is disposed at the side of the intermediate transfer belt 50 opposite to the side thereof where the image-forming unit 120 is disposed. Note that, the secondary transfer belt 24 is an endless belt supported by a pair of rollers 23. Recording paper transported on the secondary transfer belt 24 and the intermediate transfer belt 50 can be in contact with each other at the section between the roller 16 and the roller 23.

Moreover, a fixing device 25 is disposed near the secondary transfer belt 24. The fixing device 25 includes a fixing belt 26 that is an endless belt supported by a pair of rollers and a pressure roller 27 disposed to press against the fixing belt 26. Note that, a sheet reverser 28 configured to reverse recording paper when images are formed on both sides of the recording paper is disposed near the secondary transfer belt 24 and the fixing device 25.

Next, a method for forming a full-color image using the image forming apparatus 100C will be explained. First, a color document is set on a document table 130 of the automatic document feeder (ADF) 400. Alternatively, the automatic document feeder 400 is opened, a color document is set on a contact glass 32 of the scanner 300, and then automatic document feeder 400 is closed. In the case where the document is set on the automatic document feeder 400, once a start switch is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven to scan the document with the first carriage 33 and the second carriage 34. During the scanning operation, light applied from the first carriage 33 is reflected by the surface of the document, the reflected light from the surface of the document is reflected by the second carriage 34, and then the reflected light is received by a reading sensor 36 via an image formation lens 35 to read the document, to thereby image information of black, yellow, magenta, and cyan.

Figure 5:
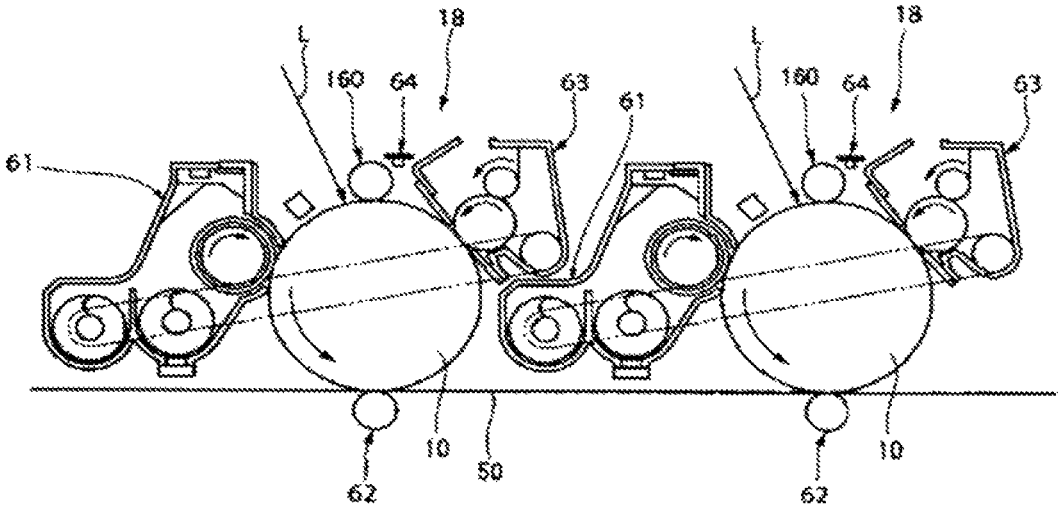
FIG. 5 is a schematic view illustrating another example of the image forming apparatus of the present disclosure.

The image information of each color is transmitted to each image forming device 18 of each image-forming unit 120 to form a toner image of each color. As illustrated in FIG. 5, the image-forming unit 120 of each color includes a photoconductor drum 10, a charging roller 160 configured to uniformly charge the photoconductor drum 10, an exposing device configured to expose the photoconductor drum 10 to exposure light L based on the image information of each color to form an electrostatic latent image for each color, a developing device 61 configured to develop the electrostatic latent image with a developer of each color to form a toner image of each color, a transfer roller 62 configured to transfer the toner image onto an intermediate transfer belt 50, a cleaning device 63 including a cleaning blade, and a charge-eliminating lamp 64.

The toner images of all of the colors formed by the image-forming units 120 of all of the colors are sequentially transferred (primary transferred) onto the intermediate transfer belt 50 rotatably supported by the rollers 14, 15, and 16 to superimpose the toner images to thereby form a composite toner image.

In the paper feeding table 200, meanwhile, one of the paper feeding rollers 142 is selectively rotated to eject recording paper from one of multiple paper feeding cassettes 144 of the paper bank 143, pieces of the ejected recording paper are separated one by one by a separation roller 145 to send each recording paper to a paper feeding path 146, and then transported by a transport roller 147 into a paper feeding path 148 within the copier main body 150. The recording paper transported in the paper feeding path 148 is then bumped against a registration roller 49 to stop. Alternatively, pieces of the recording paper on a manual-feeding tray 54 are ejected by rotating a paper feeding roller, separated one by one by a separation roller 52 to guide into a manual paper feeding path 53, and then bumped against the registration roller 49 to stop.

Note that, the registration roller 49 is generally earthed at the time of the use, but it may be biased for removing paper dusts of the recording paper. Next, the registration roller 49 is rotated synchronously with the movement of the composite toner image on the intermediate transfer belt 50, to thereby send the recording paper between the intermediate transfer belt 50 and the secondary transfer belt 24. The composite toner image is then transferred (secondary transferred) to the recording paper. Note that, the toner remained on the intermediate transfer belt 50, from which the composite toner image has been transferred, is removed by the cleaning device 17.

The recording paper to which the composite toner image has been transferred is transported on the secondary transfer belt 24 and then the composite toner image is fixed thereon by the fixing device 25. Next, the traveling path of the recording paper is switched by a switch craw 55 and the recording paper is ejected to an output tray 57 by an ejecting roller 56. Alternatively, the traveling path of the recording paper is switched by the switch craw 55, the recording paper is reversed by the sheet reverser 28, an image is formed on a back side of the recording paper in the same manner, and then the recording paper is ejected to the output tray 57 by the ejecting roller 56.

EXAMPLES

Examples of the present disclosure will be described hereinafter, but Examples shall not be construed as limiting the present disclosure. In the descriptions below, "part(s)" denotes "part(s) by mass" and "%" denotes "% by mass."

Production Example 1-1

<Synthesis of Polyester Resin A1>

A 5 L four-necked flask equipped with a nitrogen inlet tube, a dehydrating tube, a stirrer, and a thermocouple was charged with 2,120 g of sebacic acid, 0.021 g of 1,9-nonanedicarboxylic acid, and 1,200 g of 1,6-hexanediol, and the resultant mixture was allowed to react for 10 hours at 180° C., followed by heating to 200° C. and reacting for 3 hours. Moreover, the resultant was allowed to react for 2 hours at pressure of 8.3 kPa, to thereby obtain Crystalline Polyester Resin A1 (Polyester Resin A1).

An SP value of Polyester Resin A1 was 9.85 and a melting point of Polyester Resin A1 was 68.5° C.

An ortho-dichlorobenzene soluble component of Polyester Resin A1 was measured by GPC. As a result, Mw was 30,000, Mn was 6,900, and Mw/Mn was 4.4.

Production Example 1-2

<Synthesis of Polyester Resin A2>

A 5 L four-necked flask equipped with a nitrogen inlet tube, a dehydrating tube, a stirrer, and a thermocouple was charged with 2,120 g of sebacic acid, 0.021 g of 1,9-nonanedicarboxylic acid, and 1,200 g of 1,2-ethanediol, and the resultant mixture was allowed to react for 10 hours at 180° C., followed by heating to 200° C. and reacting for 3 hours. Moreover, the resultant was allowed to react for 2 hours at pressure of 8.3 kPa, to thereby obtain Crystalline Polyester Resin A2 (Polyester Resin A2).

An SP value of Polyester Resin A2 was 10.20 and a melting point of Polyester Resin A2 was 69.0° C.

An ortho-dichlorobenzene soluble component of Polyester Resin A2 was measured by GPC. As a result, Mw was 15,000, Mn was 4,900, and Mw/Mn was 3.1.

Production Example 1-3

<Synthesis of Polyester Resin A3>

A 5 L four-necked flask equipped with a nitrogen inlet tube, a dehydrating tube, a stirrer, and a thermocouple was charged with 2,120 g of 1,10-decanedicarboxylic acid, 1,000 g of 1,8-octanediol, 1,520 g of 1,4-butanediol, and 3.9 g of hydroquinone, and the resultant mixture was allowed to react for 10 hours at 180° C., followed by heating to 200° C. and reacting for 3 hours. Moreover, the resultant was allowed to react for 2 hours at pressure of 8.3 kPa, to thereby obtain Crystalline Polyester Resin A3 (Polyester Resin A3).

An SP value of Crystalline Polyester Resin A3 was 9.90 and a melting point of Crystalline Polyester Resin A3 was 67.0° C.

An ortho-dichlorobenzene soluble component of Crystalline Polyester Resin A3 was measured by GPC. As a result, Mw was 15,000, Mn was 5,000, and Mw/Mn was 3.0.

Production Example 1-4

<Synthesis of Polyester Resin A4>

A 5 L four-necked flask equipped with a nitrogen inlet tube, a dehydrating tube, a stirrer, and a thermocouple was charged with 2,120 g of sebacic acid, 0.021 g of 1,9-nonanedicarboxylic acid, and 1,490 g of 1,8-octanediol, and the resultant mixture was allowed to react for 10 hours at 180° C., followed by heating to 200° C. and reacting for 3 hours. Moreover, the resultant was allowed to react for 2 hours at pressure of 8.3 kPa, to thereby obtain Crystalline Polyester Resin A4 (Polyester Resin A4).

An SP value of Crystalline Polyester Resin A4 was 9.80 and a melting point of Crystalline Polyester Resin A4 was 69.5° C.

An ortho-dichlorobenzene soluble component of Crystalline Polyester Resin A4 was measured by GPC. As a result, Mw was 28,000, Mn was 5,700, and Mw/Mn was 4.9.

Production Example 1-5

<Synthesis of Polyester Resin A5>

A 5 L four-necked flask equipped with a nitrogen inlet tube, a dehydrating tube, a stirrer, and a thermocouple was charged with 2,220 g of sebacic acid, 0.021 g of 1,9-nonanedicarboxylic acid, and 1,720 g of 1,9-nonanediol, and the resultant mixture was allowed to react for 10 hours at 180° C., followed by heating to 200° C. and reacting for 3 hours. Moreover, the resultant was allowed to react for 2 hours at pressure of 8.3 kPa, to thereby obtain Crystalline Polyester Resin A5 (Polyester Resin A5).

An SP value of Crystalline Polyester Resin A5 is 9.75 and a melting point of Crystalline Polyester Resin A5 was 77.6° C.

An ortho-dichlorobenzene soluble component of Crystalline Polyester Resin A5 was measured by GPC. As a result, Mw was 27,000, Mn was 6,000, and Mw/Mn was 4.5.

Values of properties of Polyester Resins A1 to A5 are summarized in Table 1.

TABLE 1

| | | SP value | Melting point (° C.) | Mw | Mn | Mw/Mn |
|---|---|---|---|---|---|---|
| Production Example 1-1 | Polyester Resin A1 | 9.85 | 68.5 | 30,000 | 6,900 | 4.4 |
| Production Example 1-2 | Polyester Resin A2 | 10.2 | 69.0 | 15,000 | 4,900 | 3.1 |
| Production Example 1-3 | Polyester Resin A3 | 9.90 | 67.0 | 15,000 | 5,000 | 3.0 |
| Production Example 1-4 | Polyester Resin A4 | 9.80 | 69.5 | 28,000 | 5,700 | 4.9 |
| Production Example 1-5 | Polyester Resin A5 | 9.75 | 77.6 | 27,000 | 6,000 | 4.5 |

Production Example 2-1

<Synthesis of Amorphous Polyester Resin 1>

A 5 L four-necked flask equipped with a nitrogen inlet tube, a dehydrating tube, a stirrer, and a thermocouple was charged with 499 parts of a bisphenol A ethylene oxide (2 mol) adduct, 229 parts of a bisphenol A propylene oxide (3 mol) adduct, 100 parts of isophthalic acid, 108 parts of terephthalic acid, 46 parts of adipic acid, and 2 parts of dibutyl tin oxide, the resultant mixture was allowed to react for 10 hours at 230° C. under normal pressure, followed by reacting for 5 hours under the reduced pressure of from 10 mmHg through 15 mmHg. Thereafter, 30 parts of trimellitic anhydride was added to the reaction container, and the resultant was allowed to react for 3 hours at 180° C. under normal pressure, to thereby obtain Amorphous Polyester Resin 1.

An SP value of Amorphous Polyester Resin 1 was 11.30.

Amorphous Polyester Resin 1 had a weight average molecular weight of 5,500, a number average molecular weight of 1,800, Tg of 50° C., and an acid value of 20 mgKOH/g.

Production Example 2-2

<Synthesis of Amorphous Polyester Resin 2>

A 5 L four-necked flask equipped with a nitrogen inlet tube, a dehydrating tube, a stirrer, and a thermocouple was charged with 229 parts of a bisphenol A ethylene oxide (2 mol) adduct, 529 parts of a bisphenol A propylene oxide (3 mol) adduct, 70 parts of isophthalic acid, 98 parts of terephthalic acid, 46 parts of fumaric acid, 24 parts of dodecenyl succinic acid, and 2 parts of dibutyl tin oxide, the resultant mixture was heated with purging the container with nitrogen to maintain an inert atmosphere, and then the mixture was allowed to react through a condensation copolymerization reaction for 12 hours at 230° C. Thereafter, the pressure was gradually reduced at 230° C., to thereby obtain Amorphous Polyester Resin 2.

An SP value of Amorphous Polyester Resin 2 was 10.82.

Amorphous Polyester Resin 2 had a weight average molecular weight of 17,400, a number average molecular weight of 6,700, Tg of 61° C., and an acid value of 14 mgKOH/g.

Values of properties of the amorphous polyester resins are summarized in Table 2.

TABLE 2

| | | SP value | Tg (° C.) | Mw | Mn | Mw/Mn |
|---|---|---|---|---|---|---|
| Production Example 2-1 | Amorphous Polyester Resin 1 | 11.30 | 50.0 | 5,500 | 1,800 | 3.0 |
| Production Example 2-2 | Amorphous Polyester Resin 2 | 10.82 | 61.0 | 17,400 | 6,700 | 2.6 |

Production Example 3-1

<Synthesis of Amorphous Hybrid Resin 1>

A 5 L four-necked flask equipped with a nitrogen inlet tube, a dehydrating tube, a stirrer, and a thermocouple was charged with 7.2 g of 2,3-butanediol, 6.08 g of 1,2-propanediol, 18.59 g of terephthalic acid, and 0.18 g of tin(II) 2-ethylhexanoate, the mixture was heated with purging the container with nitrogen gas to maintain an inert atmosphere, and then the temperature was maintained at 180° C. for 1 hour. Thereafter, the temperature was elevated from 180° C. to 230° C. at 10° C./hr, followed by performing a condensation polymerization reaction for 10 hours at 230° C. The resultant was allowed to further react for 1 hour at 230° C. and at 8.0 kPa. After cooling the resultant to 160° C., 0.6 g of acrylic acid, 7.79 g of styrene, 1.48 g of 2-ethylhexyl acrylate, and dibutyl peroxide were dripped through a dropping funnel for 1 hour. After the dripping, an addition polymerization reaction was matured for 1 hour with maintaining the temperature at 160° C., followed by heating to 210° C. Thereafter, 4.61 g of trimellitic anhydride was added and the resultant was allowed to react for 2 hours at 210° C. The reaction was performed at 210° C. and at 10 kPa until a desired softening point was obtained, to thereby obtain Amorphous Hybrid Resin 1.

An SP value of Amorphous Hybrid Resin 1 was 10.80.

Amorphous Hybrid Resin 1 had a weight average molecular weight of 55,000, a number average molecular weight of 2,800, Tg of 55° C., and an acid value of 9.4 mgKOH/g.

Production Example 3-2

<Synthesis of Amorphous Hybrid Resin 2>

A 5 L four-necked flask equipped with a nitrogen inlet tube, a dehydrating tube, a stirrer, and a thermocouple was charged with 7.2 g of 2,3-butanediol, 6.08 g of 1,2-propanediol, 18.59 g of terephthalic acid, and 0.18 g of tin(II) 2-ethylhexanoate, the mixture was heated with purging the container with nitrogen gas to maintain an inert atmosphere, and then the temperature was maintained at 180° C. for 1 hour. Thereafter, the temperature was elevated from 180° C. to 230° C. at 10° C./hr, followed by performing a condensation polymerization reaction for 10 hours at 230° C. The resultant was allowed to further react for 1 hour at 230° C. and at 8.0 kPa. After cooling the resultant to 160° C., 1.0 g of acrylic acid, 8.50 g of styrene, 1.48 g of 2-ethylhexyl acrylate, and dibutyl peroxide were dripped through a dropping funnel for 1 hour. After the dripping, an addition polymerization reaction was matured for 1 hour with maintaining the temperature at 160° C., followed by heating to 210° C. Thereafter, 4.61 g of trimellitic anhydride was added and the resultant was allowed to react for 2 hours at 210° C. The reaction was performed at 210° C. and at 10 kPa until a desired softening point was obtained, to thereby obtain Amorphous Hybrid Resin 2.

An SP value of Amorphous Hybrid Resin 2 was 10.73.

Amorphous Hybrid Resin 2 had a weight average molecular weight of 26,000, a number average molecular weight of 3,400, Tg of 61.6° C., and an acid value of 13.2 mgKOH/g.

Production Example 3-3

<Synthesis of Amorphous Hybrid Resin 3>

A 5 L four-necked flask equipped with a nitrogen inlet tube, a dehydrating tube, a stirrer, and a thermocouple was charged with 6.48 g of 2,3-butanediol, 5.48 g of 1,2-propanediol, 16.71 g of terephthalic acid, and 0.16 g of tin(II) 2-ethylhexanoate, the mixture was heated with purging the container with nitrogen gas to maintain an inert atmosphere, and then the temperature was maintained at 180° C. for 1 hour. Thereafter, the temperature was elevated from 180° C. to 230° C. at 10° C./hr, followed by performing a condensation polymerization reaction for 10 hours at 230° C. The resultant was allowed to further react for 1 hour at 230° C. and at 8.0 kPa. After cooling the resultant to 160° C., 1.48 g of 2-ethylhexyl acrylate and dibutyl peroxide were dripped through a dropping funnel for 1 hour. After the dripping, an addition polymerization reaction was matured for 1 hour with maintaining the temperature at 160° C., followed by heating to 210° C. Thereafter, 5.01 g of trimellitic anhydride was added and the resultant was allowed to react for 2 hours at 210° C. The reaction was performed at 210° C. and at 10 kPa until a desired softening point was obtained, to thereby obtain Amorphous Hybrid Resin 3.

An SP value of Amorphous Hybrid Resin 3 was 10.89.

Amorphous Hybrid Resin 3 had a weight average molecular weight of 13,000, a number average molecular weight of 3,200, Tg of 55° C., and an acid value of 9.4 mgKOH/g.

Values of properties of the amorphous hybrid resins are summarized in Table 3.

TABLE 3

| | | SP value | Tg (° C.) | Mw | Mn | Mw/Mn |
|---|---|---|---|---|---|---|
| Production Example 3-1 | Amorphous Hybrid Resin 1 | 10.80 | 55.0 | 55,000 | 2,800 | 19.6 |
| Production Example 3-2 | Amorphous Hybrid Resin 2 | 10.73 | 61.6 | 26,000 | 3,400 | 7.6 |
| Production Example 3-3 | Amorphous Hybrid Resin 3 | 10.89 | 55.0 | 13,000 | 3,200 | 4.1 |

Production Example 4-1

<Preparation of Polyester Resin A Dispersion Liquid 1>

A 2 L container formed of a metal was charged with 100 parts of Polyester Resin A1 and 200 parts of ethyl acetate and the resultant mixture was heated and dissolved at 75° C. The resultant was quickly cooled at the rate of 27° C./min in an ice-water bath. To the resultant, 500 mL of glass beads (diameter: 3 mm) were added and pulverization was performed for 10 hours by means of a batch-type sand mill device (available from Kanpe Hapio Co., Ltd.), to thereby obtain Crystalline Polyester Resin A Dispersion Liquid 1.

Production Example 4-2

<Preparation of Polyester Resin A Dispersion Liquid 2>

Polyester Resin A Dispersion Liquid 2 was obtained in the same manner as in Production Example 4-1, except that Polyester Resin A1 was replaced with Polyester Resin A2.

Production Example 4-3

<Preparation of Polyester Resin A Dispersion Liquid 3>

Polyester Resin A Dispersion Liquid 3 was obtained in the same manner as in Production Example 4-1, except that Polyester Resin A1 was replaced with Polyester Resin A3.

Production Example 4-4

<Preparation of Polyester Resin A Dispersion Liquid 4>

Polyester Resin A Dispersion Liquid 4 was obtained in the same manner as in Production Example 4-1, except that Polyester Resin A1 was replaced with Polyester Resin A4.

Production Example 4-5

<Preparation of Polyester Resin A Dispersion Liquid 5>

Polyester Resin A Dispersion Liquid 5 was obtained in the same manner as in Production Example 4-1, except that Polyester Resin A1 was replaced with Polyester Resin A5.

Example 1

<Preparation of Toner 1>

—Preparation of Oil Phase—

——Synthesis of Prepolymer——

A reaction vessel equipped with a cooling tube, a stirrer, and a nitrogen inlet tube was charged with 628 parts of a bisphenol A ethylene oxide (2 mol) adduct, 81 parts of a bisphenol A propylene oxide (2 mol) adduct, 283 parts of terephthalic acid, 22 parts of trimellitic anhydride, and 2 parts of dibutyl tin oxide, the resultant mixture was allowed to react for 8 hours at 230° C. under normal pressure, and the resultant was further allowed to react for 5 hours under the reduced pressure of from 10 mmHg through 15 mmHg, to thereby obtain [Intermediate Polyester 1]. [Intermediate Polyester 1] had a number average molecular weight of 2,100, a weight average molecular weight of 9,500, Tg of 55° C., an acid value of 0.5 mgKOH/g, and a hydroxyl value of 51 mgKOH/g.

Next, a reaction vessel equipped with a cooling tube, a stirrer, and a nitrogen inlet tube was charged with 410 parts of [Intermediate Polyester 1], 89 parts of isophorone diisocyanate, and 500 parts of ethyl acetate and the resultant mixture was allowed to react for 5 hours at 100° C., to thereby obtain [Prepolymer 1]. A free isocyanate rate (% by mass) of [Prepolymer 1] was 1.53%.

——Synthesis of Ketimine——

A reaction vessel set with a stirring rod and a thermometer was charged with 170 parts of isophorone diamine and 75 parts of methyl ethyl ketone and the resultant mixture was allowed to react for 5 hours at 50° C., to thereby obtain [Ketimine Compound 1]. An amine value of [Ketimine Compound 1] was 418 mgKOH/g.

——Synthesis of Master Batch (MB)——

Water (1,200 parts), 540 parts of carbon black (PRINTEX35, available from Degussa)[DBP oil absorption=42 mL/100 mg, pH=9.5], and 1,200 parts of Amorphous Polyester Resin 1 were added together, the resultant mixture was mixed by HENSCHEL MIXER (available from Nippon Cole & Engineering Co., Ltd.), the mixture was kneaded for 30 minutes at 150° C. by means of two rolls, and then the resultant was rolled and cooled, followed by pulverization by means of a pulverizer, to thereby obtain [Master Batch 1].

——Production of Pigment/was Dispersion Liquid——

A container set with a stirring rod and a thermometer was charged with 378 parts of [Amorphous Polyester Resin 1], 50 parts of paraffin wax (HNP-9 available from Nippon Seiro Co., Ltd., hydrocarbon-based wax, melting point: 75.0° C., SP value: 8.8) as a release agent, 22 parts of CCA (salicylic acid metal complex E-84: available from Orient Chemical Industries Co., Ltd.), and 947 parts of ethyl acetate, the resultant mixture was heated to 80° C. with stirring, and the temperature was maintained at 80° C. for 5 hours, followed by cooling to 30° C. for 1 hour. Subsequently, the container was charged with 500 parts of [Master Batch 1] and 500 parts of ethyl acetate and the resultant was mixed for 1 hour, to thereby obtain [Raw Material Solution 1].

[Raw Material Solution 1] (1,324 parts) was transferred to another container and the solution was dispersed by means of a bead mill (ULTRA VISCOMILL, available from AIMEX CO., LTD.) under the conditions that the liquid feeding rate was 1 kg/hr, the disk circumferential velocity was 6 m/sec, 0.5 mm-zirconia beads were packed in the amount of 80% by volume, and the number of passes was 3. Subsequently, 1,042.3 parts of a 65% ethyl acetate solution of [Amorphous Polyester Resin 1] was added and the resultant was passed once by the bead mill under the above-described conditions, to thereby obtain [Pigment/Wax Dispersion Liquid 1]. A solid content (130° C., 30 minutes) of [Pigment/Wax Dispersion Liquid 1] was 50%.

A container was charged with 664 parts of [Pigment/Wax Dispersion Liquid 1], 109.4 parts of [Prepolymer 1], 73.9 parts of [Polyester Resin A Dispersion Liquid 1], 73.9 parts of [Amorphous Hybrid Resin 1], and 4.6 parts of [Ketimine Compound 1] and the resultant was mixed by means of TK HOMOMIXER (available from PRIMIX Corporation) for 1 minute at 5,000 rpm, to thereby obtain [Oil Phase 1].

—Synthesis of Organic Particle Emulsion (Particle Dispersion Liquid)—

A reaction vessel set with a stirring rod and a thermometer was charged with 683 parts of water, 11 parts of sodium salt of sulfuric acid ester of methacrylic acid-ethylene oxide adduct (ELEMINOL RS-30: available from Sanyo Chemical Industries, Ltd.), 138 parts of styrene, 138 parts of methacrylic acid, and 1 part of ammonium persulfate and the resultant mixture was stirred for 15 minutes at 400 rpm, to thereby obtain a white emulsion. The emulsion was heated until the internal system temperature reached 75° C. and was allowed to react for 5 hours. Moreover, 30 parts of a 1% ammonium persulfate aqueous solution was added and the resultant was matured for 5 hours at 75° C., to thereby obtain an aqueous dispersion liquid of a vinyl-based resin (styrene-methacrylic acid-sodium salt of sulfuric acid ester of methacrylic acid ethylene oxide adduct copolymer) [Particle Dispersion Liquid 1]. [Particle Dispersion Liquid 1] was measured by LA-920 (available from HORIBA, Ltd.). As a result, a volume average particle diameter thereof was 0.14 μm. Part of [Particle Dispersion Liquid 1] was dried and the resin component was separated.

—Preparation of Aqueous Phase—

Water (990 parts), 83 parts of [Particle Dispersion Liquid 1], 37 parts of a 48.5% sodium dodecyldiphenyl ether disulfonate aqueous solution (ELEMINOL MON-7: available from Sanyo Chemical Industries, Ltd.), and 90 parts of ethyl acetate were mixed together and stirred, to thereby obtain a milky white liquid that was used as [Aqueous Phase 1].

—Emulsification and Removal of Solvent—

To the container charged with [Oil Phase 1], 1,200 parts of [Aqueous Phase 1] was added. The resultant mixture was mixed by TK HOMOMIXER for 20 minutes at 13,000 rpm, to thereby obtain [Emulsified Slurry 1].

A container set with a stirrer and a thermometer was charged with [Emulsified Slurry 1] and the solvent was removed for 8 hours at 30° C. Thereafter, the resultant was matured for 4 hours at 45° C. to thereby obtain [Dispersion Slurry 1].

—Washing and Drying—

After filtering 100 parts of [Dispersion Slurry 1] under the reduced pressure, washing and drying was performed in the following manner.

(1): To the filtration cake, 100 parts of ion-exchanged water was added and the mixture was mixed by TK HOMOMIXER (for 10 minutes at the number of revolutions of 12,000 rpm).

(2): To the filtration cake obtained in (1), 100 parts of a 10% sodium hydroxide aqueous solution was added and the resultant was mixed by TK HOMOMIXER (for 30 minutes at the number of revolutions of 12,000 rpm), followed by filtration under the reduced pressure.

(3): To the filtration cake obtained in (2), 100 parts of 10% hydrochloric acid was added and the resultant was mixed by TK HOMOMIXER (for 10 minutes at the number of revolutions of 12,000 rpm), followed by filtration.

(4): To the filtration cake obtained in (3), 300 parts of ion-exchanged water was added and the resultant was mixed by TK HOMOMIXER (for 10 minutes at the number of revolutions of 12,000 rpm), followed by filtration.

The series of the operations (1) to (4) was performed twice, to thereby obtain [Filtration Cake 1].

[Filtration Cake 1] was dried with an air-circulating drier for 48 hours at 45° C., and was then passed through a sieve with a mesh size of 75 pin, to thereby obtain [Toner 1].

<Evaluations>

Developers were produced from the obtained toners in the following manner and the following evaluations were performed. The results are presented in Table 6.

<<Production of Developer Liquid>>

—Production of Carrier—

To 100 parts of toluene, 100 parts of silicone resin organo straight silicone, 5 parts of γ-(2-aminoethyl)aminopropyltrimethoxysilane, and 10 parts of carbon black were added. The resultant was dispersed by a homomixer for 20 minutes, to thereby prepare a resin layer coating liquid. The resin layer coating liquid was applied onto surfaces of spherical magnetite (1,000 parts) having an average particle diameter of 50 μm by means of a fluidized bed coater, to thereby produce a carrier.

—Production of Developer—

By means of a ball mill, 5 parts of Toner 1 and 95 parts of the carrier were mixed, to thereby produce a developer.

<<Low-Temperature Fixing Ability and Hot Offset Resistance>>

A copying test was performed on Type 6200 paper (available from Ricoh Company Limited) by means of a device where a fixing unit of a photocopier MF2200 (available from Ricoh Company Limited) had been modified to use a TEFRON (registered trade mark) roller as a fixing roller.

Specifically, a cold offset temperature (minimum fixing temperature) and a hot offset temperature (maximum fixing temperature) were determined with varying the fixing temperature.

As the evaluation conditions of the minimum fixing temperature, a linear speed of the paper feeding was from 120 mm/sec through 150 mm/sec, surface pressure was 1.2 kgf/cm$^2$, and a nip width was 3 mm.

As the evaluation conditions of the maximum fixing temperature, moreover, a linear speed of the paper feeding was 50 mm/sec, surface pressure was 2.0 kgf/cm$^2$, and a nip width was 4.5 mm.

<<Heat Resistant Storage Stability>>

A 50 mL glass container was charged with 10 g of the toner. The container was tapped until no change in the apparent density of the toner powder was observed. A lid was placed on the container and the container was left to stand for 24 hours in a constant-temperature tank of 50° C., followed by cooling to 24° C. Then, a penetration degree (mm) was measured according to a penetration test (JIS K2235-1991) and heat resistant storage stability was evaluated based on the following criteria. Note that, the larger penetration degree means more excellent heat resistant storage stability. The toner having the penetration degree of less than 15 mm is likely to cause a problem on practical use.

[Evaluation Criteria]

A: The penetration degree was 25 mm or greater.

B: The penetration degree was 20 mm or greater but less than 25 mm.

C: The penetration degree was 15 mm or greater but less than 20 mm.

D: The penetration degree was less than 15 mm.

<<Filming>>

An image was formed on 10,000 sheets by means of an image forming apparatus MF2800 (available from Ricoh Company Limited). Thereafter, the photoconductor was visually inspected. Whether the toner components, mainly the release agent, were adhered onto the photoconductor was evaluated based on the following evaluation criteria.

[Evaluation Criteria]

A: Adhesion of the toner components onto the photoconductor was not confirmed.

B: Adhesion of the toner components onto the photoconductor could be confirmed, but it was not a problematic level on practical use.

C: Adhesion of the toner components onto the photoconductor could be confirmed and it was a problematic level on practical use.

D: Adhesion of the toner components onto the photoconductor could be confirmed and it was a significantly problematic level on practical use.

<<Stress Resistance>>

A stainless steel container having a bottom surface diameter of 25 mm and a height of 30 mm was charged with 0.25 g of the toner and 4.75 g of the carrier, and the container was rotated along the circumferential direction at 300 rpm to stir the toner and the carrier and to allow the toner and the carrier to be in contact with each other. As the carrier, ferrite particles having an average particle diameter of 35 μm (available from Ricoh Company Limited) were used.

The charged amount of the stirred toner par unit area (Q/S) was measured by means of a charge measuring device TB-200 (available from Toshiba Corporation) according to the blow-off method.

Specifically, a sample unit of the charge measuring unit was charged with a measurement sample, where the stainless steel 400-mesh screen was fitted in the sample unit. Nitrogen gas was blown onto the sample for 10 seconds at blow pressure of 50 kPa (0.5 kgf/cm$^2$) in a normal temperature and normal humidity environment (20° C., 55% RH) to thereby measure a charge.

[Evaluation Criteria]

A: An absolute value of the charge amount was 200 μC/m$^2$ or greater but less than 250 μC/m$^2$.

B: An absolute value of the charge amount was 150 $\mu C/m^2$ or greater but less than 200 $\mu C/m^2$.

C: An absolute value of the charge amount was 100 $\mu C/m^2$ or greater but less than 150 $\mu C/m^2$.

D: An absolute value of the charge amount was less than 100 $\mu C/m^2$.

Example 2

<Preparation of Toner>

A toner was obtained in the same manner as in Example 1, except that [Polyester Resin A Dispersion Liquid 1] was replaced with [Polyester Resin A Dispersion Liquid 2].

The relationships of the SP values of the components of the obtained toner are presented in Table 5.

Evaluations were performed on the obtained toner in the same manner as in Example 1. The results are presented in Table 6.

Example 3

<Preparation of Toner>

A toner was obtained in the same manner as in Example 1, except that [Amorphous Hybrid Resin 1] was replaced with [Amorphous Hybrid Resin 2].

The relationships of the SP values of the components of the obtained toner are presented in Table 5.

Evaluations were performed on the obtained toner in the same manner as in Example 1. The results are presented in Table 6.

Example 4

<Preparation of Toner>

A toner was obtained in the same manner as in Example 2, except that [Amorphous Hybrid Resin 1] was replaced with [Amorphous Hybrid Resin 2].

The relationships of the SP values of the components of the obtained toner are presented in Table 5.

Evaluations were performed on the obtained toner in the same manner as in Example 1. The results are presented in Table 6.

Example 5

<Preparation of Toner>

A toner was obtained in the same manner as in Example 3, except that [Amorphous Polyester Resin 1] was replaced with [Amorphous Polyester Resin 2].

The relationships of the SP values of the components of the obtained toner are presented in Table 5.

Evaluations were performed on the obtained toner in the same manner as in Example 1. The results are presented in Table 6.

Example 6

<Preparation of Toner>

A toner was obtained in the same manner as in Example 4, except that [Amorphous Polyester Resin 1] was replaced with [Amorphous Polyester Resin 2].

The relationships of the SP values of the components of the obtained toner are presented in Table 5.

Evaluations were performed on the obtained toner in the same manner as in Example 1. The results are presented in Table 6.

Example 7

<Preparation of Toner>

A toner was obtained in the same manner as in Example 6, except that [Polyester Resin A Dispersion Liquid 2] was replaced with [Polyester Resin A Dispersion Liquid 4].

The relationships of the SP values of the components of the obtained toner are presented in Table 5.

Evaluations were performed on the obtained toner in the same manner as in Example 1. The results are presented in Table 6.

Example 8

<Preparation of Toner>

A toner was obtained in the same manner as in Example 6, except that [Polyester Resin A Dispersion Liquid 2] was replaced with [Polyester Resin A Dispersion Liquid 5].

The relationships of the SP values of the components of the obtained toner are presented in Table 5.

Evaluations were performed on the obtained toner in the same manner as in Example 1. The results are presented in Table 6.

Comparative Example 1

<Preparation of Toner>

A toner was obtained in the same manner as in Example 5, except that [Amorphous Hybrid Resin 2] was replaced with [Amorphous Hybrid Resin 3].

The relationships of the SP values of the components of the obtained toner are presented in Table 5.

Evaluations were performed on the obtained toner in the same manner as in Example 1. The results are presented in Table 6.

Comparative Example 2

<Preparation of Toner>

A toner was obtained in the same manner as in Comparative Example 1, except that [Amorphous Hybrid Resin 3] was not used.

The relationships of the SP values of the components of the obtained toner are presented in Table 5.

Evaluations were performed on the obtained toner in the same manner as in Example 1. The results are presented in Table 6.

Comparative Example 3

<Preparation of Toner>

A toner was obtained in the same manner as in Example 5, except that [Polyester Resin A Dispersion Liquid 1] was replaced with [Polyester Resin A Dispersion Liquid 3].

The relationships of the SP values of the components of the obtained toner are presented in Table 5.

Evaluations were performed on the obtained toner in the same manner as in Example 1. The results are presented in Table 6.

A list of types of the produced toners is presented in Table 4.

TABLE 4

| | Polyester Resin | | Amorphous Polyester Resin | | Amorphous Hybrid Resin | |
|---|---|---|---|---|---|---|
| | Resin No. | SP1 value | Resin No. | SP2 value | Resin No. | SP3 value |
| Ex. 1 | Polyester Resin A1 | 9.85 | Amorphous Polyester Resin 1 | 11.30 | Amorphous Hybrid Resin 1 | 10.80 |
| Ex. 2 | Polyester Resin A2 | 10.20 | Amorphous Polyester Resin 1 | 11.30 | Amorphous Hybrid Resin 1 | 10.80 |
| Ex. 3 | Polyester Resin A1 | 9.85 | Amorphous Polyester Resin 1 | 11.30 | Amorphous Hybrid Resin 2 | 10.73 |
| Ex. 4 | Polyester Resin A2 | 10.20 | Amorphous Polyester Resin 1 | 11.30 | Amorphous Hybrid Resin 2 | 10.73 |
| Ex. 5 | Polyester Resin A1 | 9.85 | Amorphous Polyester Resin 2 | 10.82 | Amorphous Hybrid Resin 2 | 10.73 |
| Ex. 6 | Polyester Resin A2 | 10.20 | Amorphous Polyester Resin 2 | 10.82 | Amorphous Hybrid Resin 2 | 10.73 |
| Ex. 7 | Polyester Resin A4 | 9.80 | Amorphous Polyester Resin 2 | 10.82 | Amorphous Hybrid Resin 2 | 10.73 |
| Ex. 8 | Polyester Resin A5 | 9.75 | Amorphous Polyester Resin 2 | 10.82 | Amorphous Hybrid Resin 2 | 10.73 |
| Comp. Ex. 1 | Polyester Resin A1 | 9.85 | Amorphous Polyester Resin 2 | 10.82 | Amorphous Hybrid Resin 3 | 10.89 |
| Comp. Ex. 2 | Polyester Resin A1 | 9.85 | Amorphous Polyester Resin 2 | 10.82 | — | — |
| Comp. Ex. 3 | Polyester Resin A3 | 9.90 | Amorphous Polyester Resin 2 | 10.82 | Amorphous Hybrid Resin 2 | 10.73 |

TABLE 5

| | Formula (1) SP1 < SP3 < SP2 | Formula (2) | | Formula (3) 0.1 < SP3 − SP1 < 1.0 | |
|---|---|---|---|---|---|
| | Fulfillment | 0.4 < SP2 − SP1 < 1.1 SP2 − SP1 | Fulfillment | SP3 − SP1 | Fulfillment |
| Ex. 1 | Fulfilled | 1.45 | Not fulfilled | 0.95 | Fulfilled |
| Ex. 2 | Fulfilled | 1.1 | Not fulfilled | 0.6 | Fulfilled |
| Ex. 3 | Fulfilled | 1.45 | Not fulfilled | 0.88 | Fulfilled |
| Ex. 4 | Fulfilled | 1.1 | Not fulfilled | 0.53 | Fulfilled |
| Ex. 5 | Fulfilled | 0.97 | Fulfilled | 0.88 | Fulfilled |
| Ex. 6 | Fulfilled | 0.62 | Fulfilled | 0.53 | Fulfilled |
| Ex. 7 | Fulfilled | 1.02 | Fulfilled | 0.93 | Fulfilled |
| Ex. 8 | Fulfilled | 1.07 | Fulfilled | 0.98 | Fulfilled |
| Comp. Ex. 1 | Not fulfilled | 0.97 | Fulfilled | 1.04 | Not fulfilled |
| Comp. Ex. 2 | Fulfilled | 0.97 | Fulfilled | — | — |
| Comp. Ex. 3 | Fulfilled | 0.92 | Fulfilled | 0.83 | Fulfilled |

TABLE 6

| | Low-temperature fixing ability Minimum fixing temperature (° C.) | Hot offset resistance Maximum fixing temperature (° C.) | Tg1st (° C.) | Heat resistant storage stability | Filming | Stress resistance |
|---|---|---|---|---|---|---|
| Ex. 1 | 118 | 170 | 50 | B | B | B |
| Ex. 2 | 113 | 165 | 47 | C | B | B |
| Ex. 3 | 118 | 170 | 51 | B | B | A |
| Ex. 4 | 113 | 165 | 48 | C | B | A |
| Ex. 5 | 118 | 170 | 51 | A | A | A |
| Ex. 6 | 113 | 165 | 48 | B | A | A |
| Ex. 7 | 118 | 170 | 50 | A | A | A |
| Ex. 8 | 115 | 170 | 50 | B | C | C |
| Comp. Ex. 1 | 118 | 170 | 49 | B | D | D |
| Comp. Ex. 2 | 118 | 170 | 52 | B | B | D |
| Comp. Ex. 3 | 125 | 180 | 51 | D | B | D |

As described above, the toners excelled in all of low-temperature fixing ability, hot offset resistance, heat resistant storage stability, stress resistance, and filming were obtained in Examples 1 to 8. Moreover, the toners having improved heat resistant storage stability, stress resistance, and filming were obtained by adjusting SP values of the polyester resin, the amorphous polyester resin, and the amorphous hybride resin.

In Comparative Example 1, it was assumed that a dispersing effect of the amorphous polyester resin to polyester resin was not sufficient to significantly deteriorate filming and stress resistance, because Formula (1) was not satisfied and the styrene-based resin was not included as the amorphous hybrid resin.

In Comparative Example 2, stress resistance was significantly deteriorated because the amorphous hybrid resin was not included.

In Comparative Example 3, heat resistant storage stability and stress resistance were significantly deteriorated because the polyester resin did not include sebacic acid as the carboxylic acid component.

What is claimed is:

1. A toner comprising:

a crystalline polyester resin comprising a constitutional unit derived from saturated aliphatic dicarboxylic acid and a constitutional unit derived from saturated aliphatic diol;

an amorphous hybrid resin;

an amorphous polyester resin;

a release agent; and a colorant, wherein the crystalline polyester resin comprises a constitutional unit derived from sebacic acid as the constitutional unit derived from the saturated aliphatic dicarboxylic acid, the amorphous hybrid resin is a composite resin comprising a styrene-based resin unit and a polyester-based resin unit comprising a polyvalent alcohol component, the styrene-based resin unit of the amorphous hybrid resin comprises a unit derived from at least one selected from the group consisting of 2-ethylhexyl acrylate, methyl acrylate, methyl methacrylate, ethyl acrylate, ethyl methacrylate, propyl acrylate, propyl methacrylate, isopropyl acrylate, isopropyl methacrylate, 2-hydroxyethyl acrylate, 2-hydroxyethyl methacrylate, isobutyl acrylate, isobutyl methacrylate, tertiarybutyl acrylate, tertiarybutyl methacrylate, 2-ethylhexyl methacrylate, octyl acrylate, octyl methacrylate, isooctyl acrylate, isooctyl methacrylate, decyl acrylate, decyl methacrylate, isodecyl acrylate, isodecyl methacrylate, stearyl acrylate, stearyl methacrylate, isostearyl acrylate and isostearyl methacrylate, the polyvalent alcohol component of the polyester-based resin unit of the amorphous hybrid resin is solely derived from a saturated aliphatic diol, the crystalline polyester resin comprises a constitutional unit derived from straight-chain aliphatic diol having from 2 through 8 carbon atoms as the constitutional unit derived from the saturated aliphatic diol, and a glass transition temperature (Tg1st) of the toner determined from a DSC curve of first heating as measured by differential scanning calorimetry (DSC) is from 45° C. through 55° C.

2. The toner according to claim 1, wherein SP1, SP2, and SP3 satisfy formulae (1) to (3) below, $$SP1<SP3<SP2 \quad \text{Formula (1)}$$

$$0.4<SP2SP1<1.1 \quad \text{Formula (2)}$$

$$0.1<SP3SP1<1.0 \quad \text{Formula (3)}$$

where SP1 is an SP value of the crystalline polyester resin, SP2 is an SP value of the amorphous polyester resin, and SP3 is an SP value of the amorphous hybrid resin.

3. A developer comprising:

the toner according to claim 1.

4. A toner stored unit comprising:

a container; and the toner according to claim 1, stored in the container.

5. An image forming apparatus comprising:

an electrostatic latent image-bearer;

an electrostatic latent image-forming unit configured to form an electrostatic latent image on the electrostatic latent image-bearer; and a developing unit that comprises the toner according to claim 1 and is configured to develop the electrostatic latent image formed on the electrostatic latent image-bearer to form a visible image.

6. An image forming method comprising:

forming an electrostatic latent image on an electrostatic latent image-bearer; and developing the electrostatic latent image formed on the electrostatic latent image-bearer with the toner according to claim 1 to form a toner image.

7. The toner according to claim 1, wherein the polyvalent alcohol component of the polyester-based resin unit of the amorphous hybrid resin is solely derived from a straight-chain saturated aliphatic diol.

8. The toner according to claim 1, wherein the polyvalent alcohol component of the polyester-based resin unit of the amorphous hybrid resin is solely derived from a linear saturated aliphatic diol having from 2 through 12 carbon atoms.

* * * * *